US008945719B2

(12) United States Patent
Abe et al.

(10) Patent No.: US 8,945,719 B2
(45) Date of Patent: Feb. 3, 2015

(54) STEEL PLATE FOR COLD FORGING AND PROCESS FOR PRODUCING SAME

(75) Inventors: Masayuki Abe, Tokyo (JP); Kengo Takeda, Tokyo (JP); Shuji Yamamoto, Tokyo (JP); Yasushi Tsukano, Tokyo (JP); Shinichi Yamaguchi, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 156 days.

(21) Appl. No.: 13/522,578

(22) PCT Filed: Jan. 25, 2011

(86) PCT No.: PCT/JP2011/051303

§ 371 (c)(1),
(2), (4) Date: Jul. 17, 2012

(87) PCT Pub. No.: WO2011/090205

PCT Pub. Date: Jul. 28, 2011

(65) Prior Publication Data

US 2012/0295123 A1 Nov. 22, 2012

(30) Foreign Application Priority Data

Jan. 25, 2010 (JP) ..... 2010-013446
Jan. 25, 2010 (JP) ..... 2010-013447

(51) Int. Cl.
*B32B 7/02* (2006.01)
*C22C 38/04* (2006.01)

(Continued)

(52) U.S. Cl.
CPC ..... *C22C 38/02* (2013.01); *C21D 8/0263* (2013.01); *C22C 38/001* (2013.01); *C22C 38/04* (2013.01);

(Continued)

(58) Field of Classification Search
None
See application file for complete search history.

(56) References Cited

U.S. PATENT DOCUMENTS 7,601,231 B2 * 10/2009 Hara et al. ..... 148/330
2009/0032148 A1 * 2/2009 Kozuma et al. ..... 148/330

FOREIGN PATENT DOCUMENTS

CN 1460128 12/2003
CN 101107375 1/2008

(Continued)

OTHER PUBLICATIONS

International Search Report dated Apr. 19, 2011, issued in corresponding PCT Application No. PCT/JP2011/051303.

(Continued)

*Primary Examiner* — Vera Katz
(74) *Attorney, Agent, or Firm* — Kenyon & Kenyon LLP

(57) ABSTRACT

This steel plate for cold forging includes a hot-rolled steel plate, wherein the hot-rolled steel plate includes: in terms of percent by mass, C: 0.13% to 0.20%; Si: 0.01% to 0.8%; Mn: 0.1% to 2.5%; P: 0.003% to 0.030%; S: 0.0001% to 0.008%; Al: 0.01% to 0.07%; N: 0.0001% to 0.02%; and O: 0.0001% to 0.0030%, with a remainder being Fe and inevitable impurities, an A value represented by the following formula (1) is in a range of 0.0080 or less, a thickness of the hot-rolled steel plate is in a range of 2 mm to 25 mm, and an area percentage of pearlite bands having lengths of 1 mm or more in a region of 4/10t to 6/10t when a plate thickness is indicated by t in a cross section of a plate thickness that is parallel to a rolling direction of the hot-rolled steel plate is in a range of not more than a K value represented by the following formula (2), $$A \text{ value} = O\% + S\% + 0.033Al\% \quad (1)$$

$$K \text{ value} = 25.5 \times C\% + 4.5 \times Mn\% - 6 \quad (2).$$

2 Claims, 7 Drawing Sheets

(51) Int. Cl.

| | |
|---|---|
| ***C22C 38/06*** | (2006.01) |
| ***C22C 38/18*** | (2006.01) |
| ***C22C 38/16*** | (2006.01) |
| ***C22C 38/12*** | (2006.01) |
| ***C22C 38/08*** | (2006.01) |
| ***C22C 38/02*** | (2006.01) |
| ***C21D 8/02*** | (2006.01) |
| ***C21D 11/00*** | (2006.01) |
| ***C22C 38/14*** | (2006.01) |
| ***C22C 38/00*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| *C21D 1/68* | (2006.01) |
| *C21D 7/02* | (2006.01) |
| *C21D 7/04* | (2006.01) |
| *C21D 9/48* | (2006.01) |

(52) U.S. Cl.

CPC ..... *C22C 38/06* (2013.01); *C22C 38/002* (2013.01); *C22C 38/005* (2013.01); *C22C 38/24* (2013.01); *C22C 38/26* (2013.01); *C22C 38/28* (2013.01); *C22C 38/32* (2013.01); *C21D 1/68* (2013.01); *C21D 7/02* (2013.01); *C21D 7/04* (2013.01); *C21D 2211/005* (2013.01); *C21D 2211/009* (2013.01); *C21D 2221/00* (2013.01); *C21D 9/48* (2013.01)

USPC ..... 428/544; 428/215; 148/505; 148/320; 148/337; 148/333; 148/332; 148/330; 148/336; 148/331

(56) References Cited

FOREIGN PATENT DOCUMENTS

| | | | |
|---|---|---|---|
| JP | 52-020967 | | 2/1977 |
| JP | 05-320773 | | 12/1993 |
| JP | 07-126807 | | 5/1995 |
| JP | 7127807 MT | * | 5/1995 |
| JP | 10-008085 | | 1/1998 |
| JP | 10-081891 | | 3/1998 |
| JP | 2002-264252 | | 9/2002 |
| JP | 2005-015854 | | 1/2005 |
| JP | 2005-139550 | | 6/2005 |
| JP | 2005-146366 | | 6/2005 |
| JP | 2005-350705 | | 12/2005 |
| JP | 2008-138237 | | 6/2008 |
| JP | 2008138237 MT | * | 6/2008 |
| WO | 2007/086202 | | 8/2007 |

OTHER PUBLICATIONS

Chinese Office Action dated Sep. 2, 2013 issued in corresponding CN Application No. 201180006836.7 [With English Translation of Search Report].

Japanese Notice of Allowance dated Dec. 4, 2012, issued in corresponding Japanese Application No. 2010-070820, and an English translation thereof.

* cited by examiner

100-FOLD MAGNIFICATION

200-FOLD MAGNIFICATION

STEEL PLATE FOR COLD FORGING AND PROCESS FOR PRODUCING SAME

TECHNICAL FIELD

The present invention relates to a steel plate for cold forging which is an appropriate material for producing parts such as engines and transmissions of automobiles, through cold forging (plate press forging) and a method for producing the same. In detail, the present invention relates to a steel plate for cold forging which inlcludes a hot-rolled steel plate having a small anisotropy in workability, a steel plate for cold forging which further includes a surface-treated film having excellent lubricity enough to endure cold forging, and a method for producing the same.

This application is a national stage application of International Application No. PCT/JP2011/051303, filed Jan. 25, 2011, which claims priority to Japanese Patent Application No. 2010-013446 filed on Jan. 25, 2010 and Japanese Patent Application No. 2010-013447 filed on Jan. 25, 2010, the contents of which are incorporated herein by reference.

BACKGROUND ART

As a working process in which metallic materials such as iron and steel materials and stainless steels are plastically deformed, mainly, there are hot forging in which a steel material is molded while being heated and cold forging in which a steel material is molded using a mold at room temperature.

In recent years, efforts have been being made to decrease weights of automobile bodies in order to reduce amount of $CO_2$ emissions from the automobiles from the viewpoint of global environmental protection, and a use of a high-strength steel plate having a strength of 440 MPa or more is proceeded. In addition, in automobile companies and parts makers, parts which were conventionally produced through hot forging are produced through cold press forging so as to simplify production steps. Simplification of steps saves energy and decreases costs in the production process; and thereby, efficiency of the process is improved. Particularly, from the viewpoint of improving the efficiency of the production process, a production method in which a plate material is subjected to cold press forging without conducting hot forging, that is, plate press forging is applied to a process of producing parts which were conventionally formed by subjecting a material such as a steel bar and the like to hot forging and cutting work so as to secure part accuracy.

However, in the case where a 440 MPa or higher-class plate material is subjected to cold plate press forging, a problem that material cracks occur is notably caused compared to hot forging. In addition, uneven formability due to rolling-induced anisotropy in the plate surface is observed. The uneven formability does not occur easily in an axially symmetric material such as a steel bar. There are a lot of problems that need to be solved such as the occurrence of cracking in a specific direction and unevenness in shape after working. At the moment, it is necessary to change a design to a shape in which cracking does not occur, and it is also necessary to carry out a step in which uneven portions occurred after drawing, so-called ear portions, are cut off. Therefore, there is a demand for a material having better workability and uniform characteristics.

As described above, in the process of producing parts, it is necessary to improve workability which is required for a material in order to greatly simplify the process steps compared to the related art. Particularly, in order to change the material from a steel bar to a steel plate, there has been a demand for an improvement of anisotropy between a rolling direction and a direction perpendicular thereto.

Particularly, unlike pressing of a steel plate having a thickness of approximately 1 mm in the related art, cold plate press forging is performed on a hot-rolled steel plate having a thickness of approximately 2 mm to 25 mm as a material for parts such as engines, transmissions, and the like, and the hot-rolled steel plate is thicker than a steel plate used for body parts in the related art. Therefore, ultimate deformability that is required during working is an important characteristic.

As a high-strength hot-rolled steel plate that is excellent in ultimate deformability and shape fixability, a hot-rolled steel plate is proposed which is obtained by controlling texture and anisotropy in ductility (for example, refer to Patent Document 1). However, Patent Document 1 does not specifically disclose cold plate press forging.

In addition, cold forging attains extremely high productivity and dimensional accuracy. In addition, a worked product worked through cold forging has advantages such as improved abrasion properties, enhanced strength due to cold work hardening, and the like. However, in cold forging, a metallic material is pressed while the metallic material is brought into contact with a mold or the like at a high surface pressure. As a result, temperature at the contact portion between the metallic material and the mold becomes a relatively high temperature (approximately 300° C. or higher) due to friction between the metallic material and the mold during pressing. Therefore, in the case where lubricity between the metallic material and the mold is not sufficient, such as the case where a metallic material that is not surface-treated or the like is subjected to cold forging, there are cases in which seizure or galling occurs between the metallic material (material) and the mold. Seizure or galling causes local breakage or abrupt abrasion of the mold; and thereby, not only there are cases in which the service life of the mold is greatly shortened, but also there are cases in which working becomes impossible.

In order to prevent seizure or galling, generally, a metallic material to be subjected to cold forging is subjected to a surface treatment for applying lubricity to a surface of the metallic material (hereinafter often referred to as "lubrication treatment"). As the lubrication treatment, a phosphate treatment (bonderizing treatment) has been known in the related art in which a phosphate film composed of a phosphate compound (zinc phosphate, manganese phosphate, calcium phosphate, iron phosphate, or the like) is formed on a surface of a metallic material.

Performance of the phosphate treatment to prevent seizure and galling is relatively strong. However, as described above, due to the recent environmental measures, cold forging is more commonly carried out than workings that involve large shape deformation, such as hot forging accompanied by large energy consumption and cutting work that causes a large amount of material loss, and there is a demand for stricter plastic working in cold forging. From the above-described viewpoint, a composite film has been widely used which further includes a layer composed of a metallic soap (for example, sodium stearate or the like) laminated on the phosphate film. The composite film has an excellent performance to prevent seizure and galling even under strict abrasion conditions due to pressing with a high surface pressure during cold forging.

According to the lubrication treatment to form the composite film, the metallic soap reacts with the phosphate film; and thereby, favorable lubricity is exhibited. However, the lubrication treatment requires a lot of cumbersome treatment steps such as a cleaning step, a reaction step in which the metallic soap and the phosphate film are reacted with each other, and the like. In the reaction step, it is also necessary to control a treatment fluid, a temperature during the reaction, and the like. In addition, since the lubrication treatment is a batch treatment, there is a problem in that the productivity degrades. In addition, the lubrication treatment to form the composite film has problems such as a treatment of a waste liquid generated during the treatment or the like, and the lubrication treatment is not preferred from the viewpoint of environmental protection.

Therefore, in recent years, a variety of lubrication treatment processes have been proposed for replacing the lubrication treatment to form the composite film.

For example, Patent Document 2 proposes a lubricant composition or the like in which a water-soluble polymer or a water-based emulsion thereof is included as a base material, and a solid lubricant and an agent for forming a chemical conversion coating film are further included. However, with regard to the lubricant composition or the like of Patent Document 2, lubricity and performance to prevent seizure and galling that are comparable to those of the above-described composite film cannot be obtained.

In addition, for example, Patent Document 3 proposes a water-based lubricant for cold plastic working of metal. The water-based lubricant is composed of (A) a water-soluble inorganic salt, (B) a solid lubricant, (C) at least one oil component selected from a mineral oil, an animal or plant fat, and a synthetic oil, (D) a surfactant, and (E) water, and the solid lubricant and the oil component are uniformly dispersed and emulsified respectively. However, since the oil component is emulsified, the lubricant obtained by the above-described technique is unstable for industrial use, and favorable lubricity is not stably exhibited.

In contrast to the above-described matters, for example, Patent Document 4 proposes a metallic material for plastic working which includes a concentration-gradient type two-layer lubricant film composed of a base layer and a lubricant layer. Patent Document 4 describes that a film having favorable lubricity can be generated through a simple treatment.

However, in the technique of Patent Document 4, adhesion between the film and a metal which is a base material is insufficient; and thereby, the film easily separates from the metal during working, particularly during strong working. Since a mold and the metal come into contact with each other at portions where the film separates, there is a problem in that seizure easily occurs at the separation portions.

PRIOR ART DOCUMENT

Patent Document

Patent Document 1: Japanese Unexamined Patent Application, First Publication No. 2005-15854

Patent Document 2: Japanese Unexamined Patent Application, First Publication No. S52-20967

Patent Document 3: Japanese Unexamined Patent Application, First Publication No. H10-8085

Patent Document 4: Japanese Unexamined Patent Application, First Publication No. 2002-264252

DISCLOSURE OF THE INVENTION

Problems to be Solved by the Invention

The present invention has been made in consideration of the above-described circumstances, and the present invention aims to provide a steel plate for cold forging and a method for producing the same. The steel plate for cold forging can improve workability in a process where parts for engines and transmissions are produced through cold forming, so-called plate press forging, and the parts for engines and transmissions were conventionally manufactured through hot forging and the like.

Means for Solving the Problems

The present inventors carried out thorough studies so as to solve the above-described problems. As a result, the inventors found that reduction of anisotropy in workability cannot be realized simply by changing rolling conditions, and it is important to consistently control and optimize components and relevant structures through a hot rolling step. Specifically, an amount of oxides, a content of S, and a content of Al during smelting are defined, and conditions from hot rolling to coiling are optimized. Thereby, the structure is controlled. As a result, it was revealed that the above-described controlling of the structure can solve the above-described problems and stably improve anisotropy in workability. Particularly, in the case where plastic deformability degrades due to portions at which non-metallic inclusions and carbides that are so-called pearlite bands are present in a dense state in a central area of a plate thickness, anisotropies in workability in a rolling direction and in a direction perpendicular thereto increase. The fact that the pearlite bands take a form that extends lengthwise in the rolling direction due to rolling facilitates anisotropy in plastic deformability. It was found that an increase in the anisotropy in workability can be suppressed by defining a relationship between an area percentage and components of the pearlite bands. In addition, it was also found that an elongation rate of the pearlite bands in the rolling direction and a fraction of the pearlite bands can be controlled by controlling the rolling conditions of the hot rolling, cooling conditions, and coiling conditions in a series.

In addition, thorough studies were also carried out regarding a surface-treated film. As a result, it was found that excellent lubricity can be applied to a steel plate by providing a concentration-gradient type surface-treated film and controlling thicknesses of respective constituent layers. The concentration-gradient type surface-treated film is provided by a simple treatment process that does not cause a problem regarding waste liquid treatment. The concentration-gradient type surface-treated film is composed of three layers of an adhesion layer for securing adhesion to the steel plate which serves as a base material, a base layer for holding a lubricant, and a lubricant layer for improving lubricity.

A steel plate for cold forging according to an aspect of the invention includes a hot-rolled steel plate, wherein the hot-rolled steel plate includes: in terms of percent by mass, C, 0.13% to 0.20%; Si: 0.01% to 0.8%; Mn: 0.1% to 2.5%; P: 0.003% to 0.030%; S: 0.0001% to 0.008%; Al: 0.01% to 0.07%; N: 0.0001% to 0.02%; and O: 0.0001% to 0.0030%, with a remainder being Fe and inevitable impurities, and an A value represented by the following formula (1) is in a range of 0.0080 or less. A thickness of the hot-rolled steel plate is in a range of 2 mm to 25 mm, and an area percentage of pearlite bands having lengths of 1 mm or more is in a range of not more than a K value represented by the following formula (2) in a region of $\frac{4}{10}t$ to $\frac{6}{10}t$ when a plate thickness is indicated by t in a cross section of a plate thickness that is parallel to a rolling direction of the hot-rolled steel plate.

$$A\ \text{value} = O\% + S\% + 0.033Al\% \quad (1)$$

$$K\ \text{value} = 25.5 \times C\% + 4.5 \times Mn\% - 6 \quad (2)$$

In the steel plate for cold forging according the aspect of the invention, the hot-rolled steel plate may further include, in terms of percent by mass, one or more selected from a group consisting of: Nb: 0.001% to 0.1%; Ti: 0.001% to 0.05%; V: 0.001% to 0.05%; Ta: 0.01% to 0.5%; and W: 0.01% to 0.5%.

The hot-rolled steel plate may further include, in terms of percent by mass, Cr: 0.01% to 2.0%, and the area percentage of the pearlite bands having lengths of 1 mm or more may be in a range of not more than a K' value represented by the following formula (3).

$$K' \text{ value}=15\times C\%+4.5\times Mn\%+3.2\times Cr\%-3.3 \quad (3)$$

The hot-rolled steel plate may further include, in terms of percent by mass, one or more selected from a group consisting of: Ni: 0.01% to 1.0%; Cu: 0.01% to 1.0%; Mo: 0.005% to 0.5%; and B: 0.0005% to 0.01%.

The hot-rolled steel plate may further include, in terms of percent by mass, one or more selected from a group consisting of: Mg: 0.0005% to 0.003%; Ca: 0.0005% to 0.003%; Y: 0.001% to 0.03%; Zr: 0.001% to 0.03%; La: 0.001% to 0.03%; and Ce: 0.001% to 0.03%.

The steel plate for cold forging may further include a surface-treated film provided on either one or both of main surfaces of the hot-rolled steel plate, and the surface-treated film may include a component originating from a silanol bond represented by Si—O—X (X represents a metal that is a component of the hot-rolled steel plate), a high-temperature resin, an inorganic acid salt, and a lubricant. The surface-treated film may have a concentration gradient of each component in a film thickness direction so as to have a concentration-gradient type three-layer structure that can be identified to be three layers of an adhesion layer, a base layer, and a lubricant layer situated in series from a side of an interface between the surface-treated film and the hot-rolled steel plate. The adhesion layer may be a layer that includes a largest amount of the component originating from the silanol bond among the three layers, and a thickness of the adhesion layer may be in a range of 0.1 nm to 100 nm. The base layer may be a layer that includes largest amounts of the high-temperature resin and the inorganic acid salt among the three layers, the amount of the inorganic acid salt in the base layer may be in a range of 1 part by mass to 100 parts by mass with respect to 100 parts by mass of the high-temperature resin, and a thickness of the base layer may be in a range of 0.1 μm to 15 μm. The lubricant layer may be a layer that includes a largest amount of the lubricant among the three layers, and a thickness of the lubricant layer may be in a range of 0.1 μm to 10 μm. A ratio of the thickness of the lubricant layer to the thickness of the base layer may be in a range of 0.2 to 10.

The inorganic acid salt may be at least one compound selected from a group consisting of phosphate, borate, silicate, molybdate, and tungstate.

The high-temperature resin may be a polyimide resin.

The lubricant may be at least one compound selected from a group consisting of polytetrafluoroethylene, molybdenum disulfide, tungsten disulfide, zinc oxide, and graphite.

A method for producing a steel plate for cold forging according to an aspect of the invention includes: heating a slab at a temperature of 1150° C. to 1300° C.; subjecting the heated slab to rough rolling at a temperature of 1020° C. or higher so as to make a rough bar; subjecting the rough bar to finishing rolling under a condition where a finishing temperature is in a range of $Ae_3$ or higher so as to make a rolled material; after the finishing rolling, subjecting the rolled material to air cooling for 1 second to 10 seconds; after the air cooling, cooling the rolled material at a cooling rate of 10° C./s to 70° C./s to a coiling temperature; and coiling the cooled rolled material at the coiling temperature of 400° C. to 580° C. so as to make a hot-rolled steel plate. The slab includes: in terms of percent by mass, C, 0.13% to 0.20%; Si: 0.01% to 0.8%; Mn: 0.1% to 2.5%; P: 0.003% to 0.030%; S: 0.0001% to 0.006%, Al: 0.01% to 0.07%, N: 0.0001% to 0.02%, and O: 0.0001% to 0.0030% with a remainder being Fe and inevitable impurities, and an A value represented by the following formula (1) is in a range of 0.0080 or less. The rough rolling includes a first rolling and a second rolling that is carried out 30 seconds or more after an end of the first rolling. The first rolling is carried out under conditions where a temperature is in a range of 1020° C. or higher and a sum of rolling reduction rates is in a range of 50% or more, and the second rolling is carried out under conditions where a temperature is in a range of 1020° C. or higher and a sum of rolling reduction rates is in a range of 15% to 30%.

$$A \text{ value}=O\%+S\%+0.033Al\% \quad (1)$$

The method for producing a steel plate for cold forging according to the aspect of the invention may further include: coating a water-based surface treatment fluid including a water-soluble silane coupling agent, a water-soluble inorganic acid salt, a water-soluble high-temperature resin, and a lubricant on either one or both of main surfaces of the hot-rolled steel plate so as to form a coated film; and drying the coated film so as to form a surface-treated film on either one or both of the main surfaces of the hot-rolled steel plate.

Meanwhile, $Ae_3$ refers to a value computed from the following formula.

$$Ae_3(°\text{ C.})=910-372\times C\%+29.8\times Si\%-30.7\times Mn\%+776.7\times P\%-13.7\times Cr\%-78.2Ni\%$$

Effects of the Invention

According to the aspect of the invention, it is possible to provide a steel plate for cold forging which has a 440 MPa-class to 780 MPa-class high strength and is used as a material for automobile parts. In addition, the steel plate for cold forging has a relatively thick thickness of 2 mm or more, and reduced anisotropies in workability in a rolling direction and in a direction perpendicular thereto. In detail, it is possible to provide a steel plate (hot-rolled steel plate) for cold forging which has small anisotropy in workability so that anisotropy in ultimate deformability (ultimate deformation ratio) during cold press forging working is in a range of 0.9 or more; and thereby, cracking can be prevented during press forging working.

In addition, in the case where the above-described concentration-gradient type surface-treated film is further included which is composed of three layers of the adhesion layer, the base layer, and the lubricant layer, it is possible to provide a steel plate for cold forging which can be produced by a simple treatment step and is preferable even from the viewpoint of global environmental protection. In addition, the steel plate for cold forging has excellent lubricity and excellent performance to prevent seizure and galling.

Therefore, according to the steel plate for cold forging according to the aspect of the invention, workability can be improved in cold forming, so-called plate press forging. Thereby, parts for engines or transmissions which were produced by hot forging and the like in the related art can be produced by plate press forging. Therefore, the steel plate for cold forging according to the aspect of the invention is effective for simplifying steps such as production steps of automobile parts, and the like and reducing costs of the steps; and thereby, the steel plate for cold forging according to the aspect of the invention contributes to energy saving.

BEST MODE FOR CARRYING OUT THE INVENTION

Hereinafter, preferable embodiments of the invention will be described in detail with reference to the accompanying drawings. Meanwhile, in the present specification and the drawings, components (constituents) having substantially the same function will be given the same reference sign so that duplicate description will not be made.

(First Embodiment)

[Steel Plate for Cold Forging According to the First Embodiment]

The steel plate for cold forging according to the first embodiment is composed of a hot-rolled steel plate. The hot-rolled steel plate has small anisotropy in workability and is excellent in workability. The hot-rolled steel plate will be described below.

Firstly, 50 kg of steel ingots having the following chemical components were melted under vacuum in a laboratory in order to investigate influences of the components of the hot-rolled steel plate on characteristics.

(i) A steel ingot containing 0.15% C-0.2% Si-0.3% Mn-0.5% Cr-0.002% B as basic components and having a variety of contents of S, O, and Al. (ii) A steel ingot containing 0.14% C-0.25% Si-1.45% Mn as basic components and having a variety of contents of S, O, and Al.

The respective steel ingots were heated to 1200° C., and subsequently, the steel ingots were subjected to hot-rolling under conditions where a thickness was decreased from 100 mm to 10 mm. After the hot rolling was ended at 900° C., the steel ingots were subjected to air-cooling for 3 seconds. Next, the steel ingots were cooled to 500° C. at a cooling rate of 30° C./s. Thereafter, the steel ingots were retained in a furnace at 500° C. for 1 hour, and then the steel ingots were cooled in the furnace so as to simulate an actual coiling step.

A tension test specimen of a round bar having a diameter of 8 mm was taken along a rolling direction of each of the obtained hot-rolled steel plates. Similarly, a tension test specimen of a round bar having a diameter of 8 mm was taken along a direction perpendicular with respect to the rolling direction. Tensile tests (tension tests) were carried out using the test specimens. Ultimate deformabilities were measured from cross section shrinkage rates of the test specimens after the tests. The ultimate deformability in the rolling direction was indicated by ϕL, the ultimate deformability in the direction perpendicular with respect to the rolling direction was indicated by ϕc, and a relationship between ratios (ϕc/ϕL) and the components was investigated. Here, the ultimate deformability is calculated from the following formula. In addition, a value of the ratio (ϕc/ϕL) approaching to 1 means small anisotropy in workability.

$$\text{Ultimate deformability } \phi = \ln(S_0/S)$$

(Herein, $S_0$ refers to a cross-sectional area of the test specimen before the tension test, and S refers to a cross-sectional area of a broken portion after the tension test)

Figure 1:
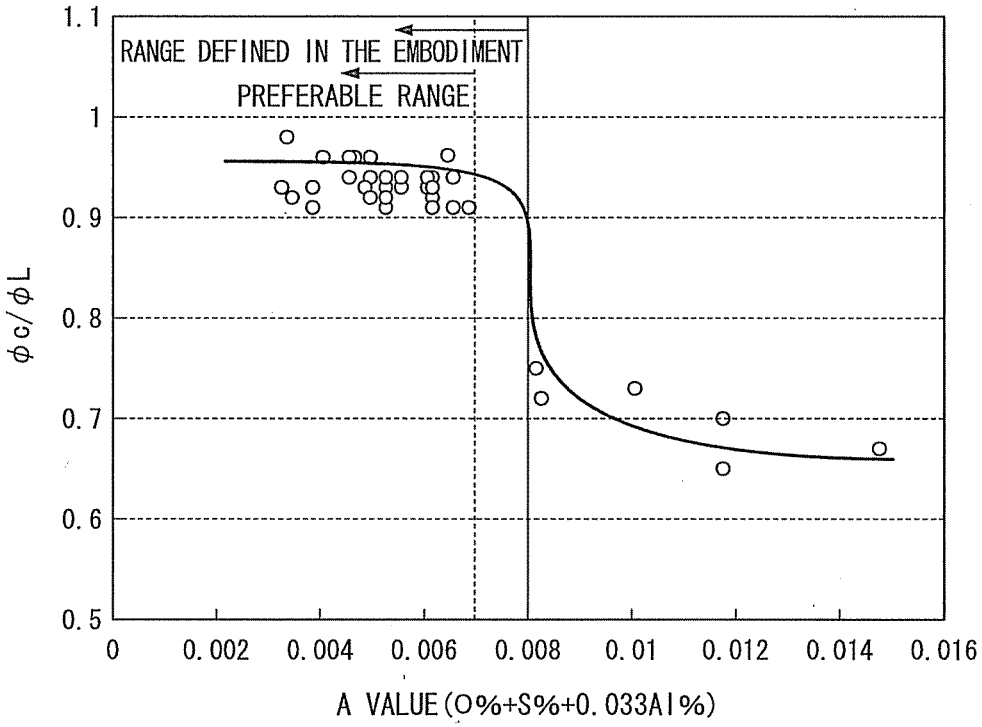
FIG. 1 is a view showing a relationship between A values and anisotropies (ϕc/ϕL) in ultimate deformability with regard to hot-rolled steel plates containing 0.15% C-0.2% Si-0.3% Mn-0.5% Cr-0.002% B as basic components.
Figure 2:
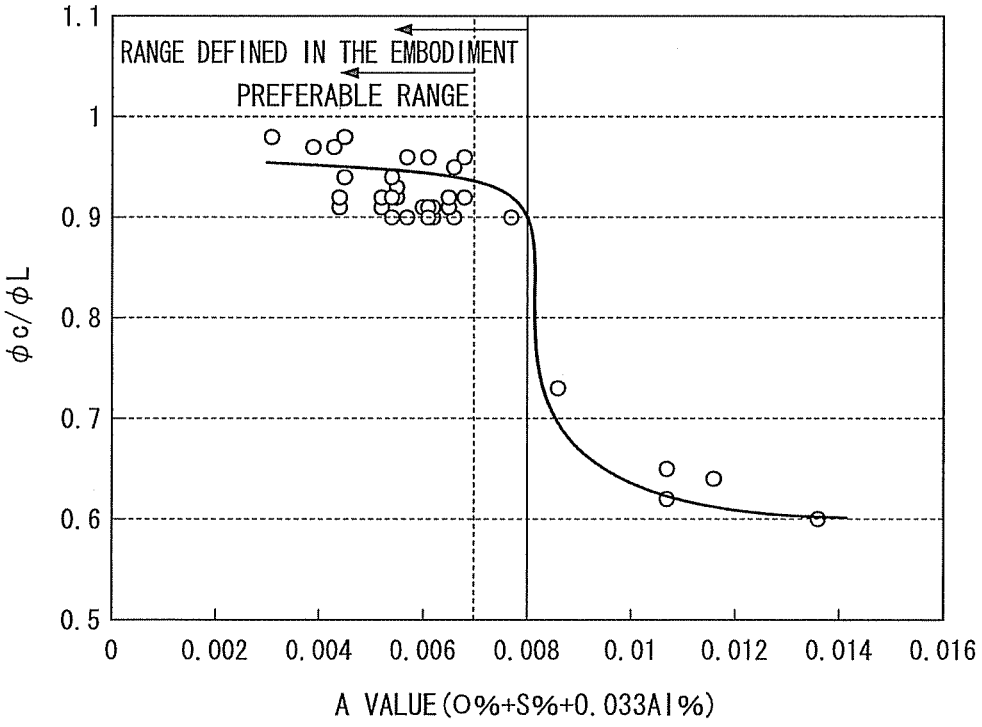
FIG. 2 is a view showing a relationship between A values and anisotropies (ϕc/ϕL) in ultimate deformability with regard to hot-rolled steel plates containing 0.14% C-0.25% Si-1.45% Mn as basic components.

FIG. 1 is a view showing a relationship between A values and anisotropies (ϕc/ϕL) in ultimate deformability with regard to the hot-rolled steel plates having the chemical components of the above-described (i). In addition, FIG. 2 is a view showing a relationship between A values and anisotropies (ϕc/ϕL) in ultimate deformability with regard to the hot-rolled steel plate having the chemical components of the above-described (ii).

As a result of regression analyses regarding a relationship between the ultimate deformabilities in the rolling direction and either one of contents of O (O %), contents of S (S %), and contents of Al (Al %), the A value represented by the following formula (1) was determined.

$$A \text{ value} = O\% + S\% + 0.033Al\% \quad (1)$$

(Here, O %, S %, and Al % represent contents (% by mass) of O, S, and Al included in the hot-rolled steel plate, respectively.)

In the relational formula that represents the A value, the coefficients (1) of the content of S and the content of O are large compared to the coefficient (0.033) of the content of Al; and therefore, it is found that influences of the content of S and the content of O on the ultimate deformability in the rolling direction are large. Generally, it is considered that uneven distribution of inclusions in interfaces and the like influence the ultimate deformability. In the relational formula that represents the A value, it is considered as follows. The fact that the coefficients of the content of Al, the content of S, and the content of O are different shows that the influences on the uneven distribution of the inclusions vary by the components.

As shown in FIG. 1, it is found that, as the A value calculated from the content of O (O %), the content of S(S %), and the content of Al (Al %) increases, the relative ratio (ϕc/ϕL) of the ultimate deformability ϕc in the direction perpendicular with respect to the rolling direction to the ultimate deformability ϕL in the rolling direction decreases; and therefore, anisotropy in workability increases. As shown in FIG. 1, it was determined that, in the case where the A value is in a range of 0.008 or less, the cross section shrinkage rate in the direction perpendicular to the rolling direction becomes a value close to the cross section shrinkage rate in the rolling direction, the ratio of $\phi c/\phi L$ becomes in a range of 0.9 or more; and therefore, a steel plate having small anisotropy in workability can be produced.

Similarly, even in FIG. 2, a correlation between the anisotropies ($\phi c/\phi L$) in ultimate deformability and the A values was obtained. It was confirmed that, in the case where in the case where the A value is in a range of 0.007 or less, the cross section shrinkage rate in the direction perpendicular to the rolling direction becomes a value close to the cross section shrinkage rate in the rolling direction, the ratio of $\phi c/\phi L$ becomes in a range of 0.9 or more; and therefore, a steel plate having small anisotropy in workability can be produced.

It is considered that the total amount of non-metallic inclusions is decreased by decreasing the content of oxygen (O %); and thereby, the anisotropy is decreased. In addition, it is considered that in the case where an excessive content of Al is not added, an amount of coarse alumina-based non-metallic inclusion; and thereby, the anisotropy is decreased. Furthermore, it was confirmed that influences of S on MnS and the like can be controlled in conjunction with O and Al by decreasing the content of S(S %).

In addition, a relationship between production conditions and anisotropies ($\phi c/\phi L$) in ultimate deformability was investigated using slabs (billets) having the following chemical components.

(iii) A slab having components of 0.19% C-0.15% Si-0.66% Mn-0.65% Cr-0.015% P-0.0017% S-0.024% Al-0.0018%0-0.0016% B.

(iv) A slab having components of 0.15% C-0.2% Si-1.51% Mn-0.02% P-0.0015% S-0.032% Al-0.0021% O.

As a result, it was found that, other than the chemical components, there is a relationship between a presence state of pearlite bands and anisotropy in ultimate deformability. Particularly, in a hot-rolled steel plate produced from a slab using an actual machine, a presence fraction (area percentage) of pearlite bands extending in a rolling direction is high in a central portion of a plate thickness. In the central area in a region of 4/10t to 6/10t in which the plate thickness is indicated by t, the higher the presence fraction of pearlite bands having a length of 1 mm or longer is, the more the ultimate deformability ($\phi c$) in the direction perpendicular to the rolling direction decreases. As a result, the anisotropy in ultimate deformability becomes less than 0.9; and therefore, anisotropy in workability becomes large.

Figure 3:
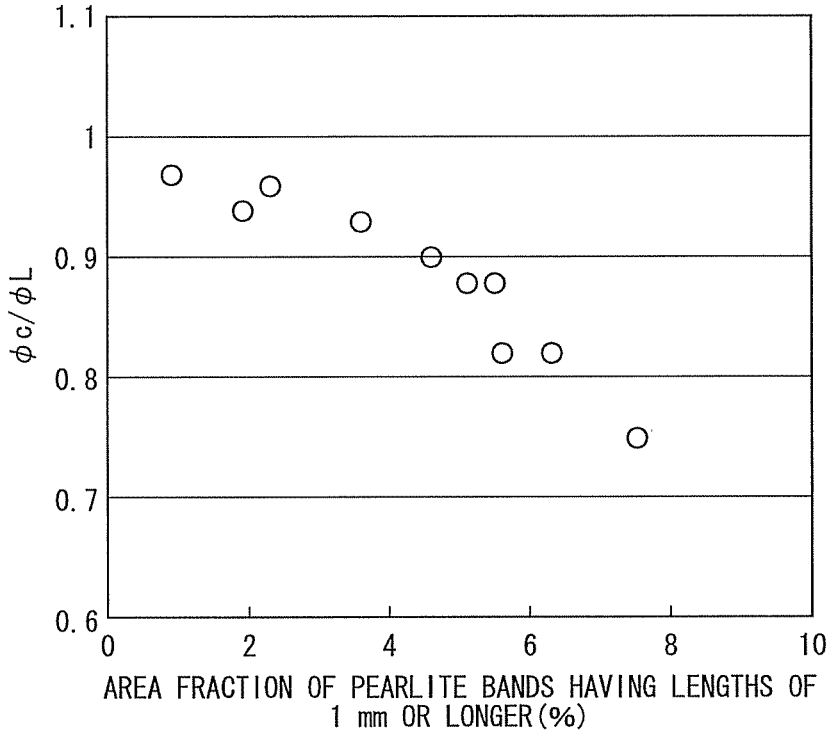
FIG. 3 is a view showing a relationship between area percentages (%) of pearlite bands in a central portion of a plate thickness and anisotropies (ϕc/ϕL) in ultimate deformability with regard to hot-rolled steel plates having chemical components of 0.19% C-0.15% Si-0.66% Mn-0.65% Cr-0.015% P-0.0017% S-0.024% Al-0.0018% O-0.0016% B.
Figure 4:
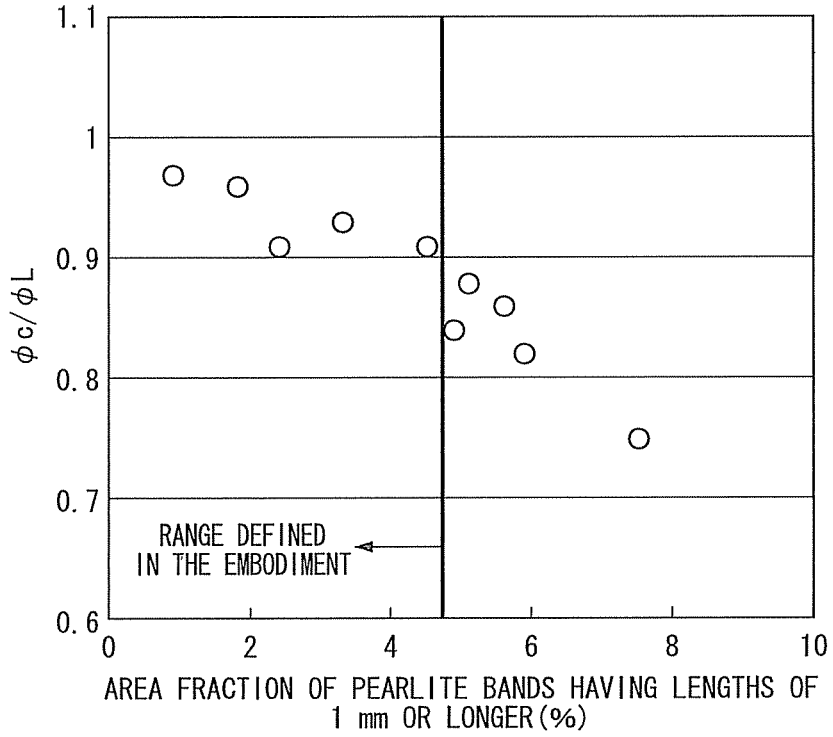
FIG. 4 is a view showing a relationship between area percentages (%) of pearlite bands in a central portion of a plate thickness and anisotropies (ϕc/ϕL) in ultimate deformability with regard to hot-rolled steel plates having chemical components of 0.15% C-0.2% Si-1.51% Mn-0.02% P-0.0015% S-0.032% Al-0.0021% O.

Here, the pearlite band refers to a band-shaped aggregate having a length of 1 mm or longer in which pearlites having thicknesses of 5 μm or more in a plate thickness are arranged in a rolling direction at intervals of 20 μm or less. The presence fraction (area percentage) (%) of the pearlite bands was measured by the following method. A cross-sectional portion of the plate thickness that is parallel to the rolling direction was taken. The cross-sectional portion was subjected to a polishing treatment, and then, the cross-sectional portion was immersed in a Nital solution (a solution including approximately 5% of nitric acid with the remainder being alcohol); and thereby, pearlite emerged. Next, with regard to the central portion of the plate thickness in a region of 4/10t to 6/10t with respect to the plate thickness t, the structure was photographed using an optical microscope (at a 100-fold magnification), and the obtained images were connected. The connected images were subjected to image analysis using an image analysis software (WinROOF Ver. 5.5.0 manufactured by Mitani Corporation); and thereby, the area percentage of the pearlite bands was obtained. The obtained results are shown in FIGS. 3 and 4. In the chemical component systems of the above-described (iii) and (iv), it was determined that, in the case where the area percentage of the pearlite bands having sizes of 1 mm or more is in a range of 4.6% or less in the central portion of the plate thickness, the anisotropy in ultimate deformability becomes 0.9 or more; and therefore, the anisotropy in workability becomes small.

The inventors further investigated a relationship between the above-described area percentage of the pearlite bands and the ultimate deformability. As a result, it was found that the area percentage of the pearlite bands for maintaining the anisotropy in ultimate deformability in a range of 0.9 or more highly relates to the chemical components. Relationships between the area percentage of the pearlite bands and the contents of a variety of components were subjected to regression analysis. As a result, it was found that, with regard to the component system of the present embodiment, in the case where the area percentage of the pearlite bands is in a range of not more than the K value indicated by the following formula (2), the anisotropy in ultimate deformability becomes 0.9 or more. In addition, it was found that, in the case where Cr is included, and the area percentage of the pearlite bands is in a range of not more than the K' value indicated by the following formula (3), the anisotropy in ultimate deformability becomes 0.9 or more.

$$K\ \text{value}=25.5\times C\%+4.5\times Mn\%-6 \quad (2)$$

$$K'\ value=15\times C\%+4.5\times Mn\%+3.2\times Cr\%-3.3 \quad (3)$$

(Herein, C %, Mn %, and Cr % refer to the contents (% by mass) of C, Mn, and Cr included in the hot-rolled steel plate, respectively.)

It is found from the relational formulae representing the K value and the K' value that formation of the pearlite bands is strongly affected by the contents of C, Mn, and Cr which are basic components. In the component system of the present embodiment, it is important to set the chemical components and the production conditions so that the area percentage of the pearlite bands becomes the K value or less and the K' value or less.

The chemical components of the hot-rolled steel plate in the present embodiment are set based on the above-described finding. Reasons why the components and composition of the hot-rolled steel plate in the present embodiment are limited will be described below. Meanwhile, "%" refers to "% by mass."

(Chemical Components)

C: 0.13% to 0.20%

C is an important component for securing a strength of the hot-rolled steel plate. However, machinability is required to work (form) members for automobiles which are targets of the present embodiment. In the case where the content of C is less than 0.13%, the amount of carbides decreases; and thereby, machinability deteriorates. Therefore, 0.13% or more of C is required so as to secure machinability. On the other hand, in the case where the content of C exceeds 0.20%, workability degrades in the hot-rolled steel plate in a state in which nothing is carried out thereon after production. Therefore, the content of C is set to be in a range of 0.13% to 0.20%. The content of C is preferably in a range of 0.13% to 0.18%, and more preferably in a range of 0.14% to 0.17%.

Si: 0.01% to 0.8%

Si is a solid-solution strengthening element; and therefore, Si can enhance the strength of the steel plate at a relatively low cost. In addition, it is necessary to add a small content of Si on consideration of a relationship between C and scale flaws. Therefore, the content of Si is set to 0.01% or more; however, in the case where the content of Si exceeds 0.8%, the effect is saturated. Therefore, the content of Si is set to be in a range of 0.01% to 0.8%. The content of Si is preferably in a range of 0.03% to 0.5%, and more preferably in a range of 0.1% to 0.3%.

Mn: 0.1% to 2.5%

Mn is a solid-solution strengthening element; and therefore, Mn is an important component for securing a desired high tensile strength. In the case where the content of Mn is less than 1.0%, it is necessary to contain other strengthening elements in order to secure a necessary strength; and thereby, the costs increase, which is not preferable. On the other hand, as the content of Mn increases, pearlite bands become liable to be generated due to segregation of Mn. In the case where the content of Mn exceeds 2.5%, segregation to a center portion becomes significant in a slab (billet); and as a result, workability of the hot-rolled steel plate in a direction perpendicular to a rolling direction degrades even when the steel plate is produced by the production method of the present embodiment. Therefore, the content of Mn is set to be in a range of 0.1% to 2.5%. The content of Mn is preferably in a range of more than 0.3% to 2.0% or less, more preferably in a range of 0.4% to 1.7%, and most preferably in a range of 0.6% to 1.5%.

P: 0.003% to 0.030%

P is a solid-solution strengthening element; and therefore, P is an element that can enhance the strength of the steel plate at a relatively low cost. However, it is not preferable to include an excessive content of P from the viewpoint of toughness. Therefore, the content of P is set to be in a range of 0.03% or less. In addition, from the viewpoint of refining, setting of the content of P to be in a range of less than 0.003% leads to an increase in costs. Therefore, the content of P is set to be in a range of 0.003% to 0.030%. The content of P is preferably in a range of 0.003% to 0.020%, and more preferably in a range of 0.005% to 0.015%.

S: 0.0001% to 0.008%

S is included in a steel as an impurity, and S forms MnS. MnS causes degradation of durability and toughness of the steel plate which determines workability of cold working. Particularly, since MnS increases anisotropy in workability, it is necessary to reduce the content of S from the viewpoint of reducing the amount of MnS. Therefore, the content of S is set to be in a range of 0.008% or less. In addition, setting of the content of S to be in a range of less than 0.0001% leads to a great increase in refining costs. Therefore, the content of S is set to be in a range of 0.0001% to 0.008%. The content of S is preferably in a range of 0.0001% to 0.005%, and more preferably in a range of 0.0001% to 0.004%.

Al: 0.01% to 0.07%

Al is an element that is added for deoxidization of a steel; however, in the case where the content of Al is less than 0.01%, deoxidization effect is not sufficient. On the other hand, in the case where the content of Al exceeds 0.07%, the deoxidization effect is saturated. In addition, in a process in which a curved slab is produced through continuous casting, when the obtained slab is subjected to bending correction, Al facilitates cracking due to precipitation of AlN, and this results in an economic disadvantage. Therefore, the content of Al is set to be in a range of 0.01% to 0.07%. The content of Al is preferably in a range of 0.01% to 0.04%.

N: 0.0001% to 0.02%

When bonding correction of the slab is carried out using a curved continuous casting facility, precipitation of N as a nitride causes cracking in the slab. Therefore, the content of N is set to be in a range of 0.02% or less. In addition, reducing of the content of N to less than 0.0001% leads to an increase in the refining costs. Therefore, the content of N is set to be in a range of 0.0001% to 0.02%. The content of N is preferably in a range of 0.0001% to 0.01%, and more preferably in a range of 0.0001% to 0.005%.

O: 0.0001% to 0.0030%

Since some of O atoms exist as oxides, O has an influence on the workability of cold working, and O causes degradation of durability and toughness. In the case where the content of O increases, inclusions become large. In addition, in the case where the inclusions aggregate, the ductility lowers greatly. Therefore, the content of O is set to be in a range of 0.0001% to 0.0030%. It is desirable that the content of O be reduced as much as possible, and the content of O is preferably in a range of 0.0001% to 0.0025%, and more preferably in a range of 0.0001% to 0.0020%.

In the present embodiment, as a result of considering both of the chemical components and the production conditions, it was confirmed that degradation of the workability can be suppressed by fulfilling the following formula. Therefore, the content of oxygen (O %) is adjusted according to the content of S(S %) and the content of Al (Al %) so as to fulfill the following formula. The A value in the following formula is preferably in a range of 0.0070 or less. The lower limit of the A value is preferably 0.0010. Setting of the A value to be in a range of less than 0.0010 leads to a great increase in the refining costs, which is not preferable.

$$A \text{ value} = O\% + S\% + 0.033Al\% \leq 0.0080$$

Next, components that the hot-rolled steel plate of the embodiment may selectively contain according to necessity will be described.

Nb: 0.001% to 0.1%

Nb has effects of improving the strength of the steel plate and improving the toughness of the steel plate through a grain refining action. In the present embodiment, Nb may be included as a selective element. However, in the case where the content of Nb is less than 0.003%, the above-described effects cannot be sufficiently obtained. On the other hand, in the case where the content of Nb exceeds 0.1%, the effects are saturated, and this leads to an economic disadvantage. In addition, in the case where an excessive content of Nb is included, recrystallization behaviors during hot rolling are delayed. Therefore, the content of Nb is set to be in a range of 0.001% to 0.1%. The content of Nb is preferably in a range of 0.003% to 0.1%.

Ti: 0.001% to 0.05%

Ti may be added from the viewpoint of fixing of N, and Ti contributes to embrittlement of the slab and stabilization of a material. However, in the case where the content of Ti exceeds 0.05%, the effects are saturated. In addition, in the case where the content of Ti is 10 ppm or less, the effects cannot be obtained. Therefore, the content of Ti is set to be in a range of 0.001% to 0.05%.

V: 0.001% to 0.05%

V strengthens the hot-rolled steel plate through precipitation of carbonitrides. Therefore, V may be added according to necessity. In the case where the content of V is less than 0.001%, the effect is small. In addition, in the case where the content of V exceeds 0.05%, the effect is saturated. Therefore, the content of V is set to be in a range of 0.001% to 0.05%.

Ta: 0.01% to 0.5%

Similarly to Nb and V, Ta is an element that forms carbonitrides, and Ta is effective for prevention of coarsening of crystal grains, improvement of toughness, and the like; and therefore, Ta may be added according to necessity. In the case where the content of Ta is less than 0.01%, the effect of the addition is small; and therefore, the lower limit of the content of Ta is set to 0.01%. In the case where the content of Ta exceeds 0.5%, the effect of the addition is saturated, and the costs increase. In addition, an excessive amount of carbides are formed; and thereby, recrystallization and the like are delayed. As a result, anisotropy in workability is increased. Therefore, the upper limit of the content of Ta is set to 0.5%.

W: 0.01% to 0.5%

Similarly to Nb, V, and Ta, W is an element that forms carbonitrides, and W is effective for prevention of coarsening of crystal grains, improvement of toughness, and the like, and W may be added according to necessity. In the case where the content of W is less than 0.01%, the effect of the added W is small; and therefore, the lower limit of the content of W is set to 0.01%. In the case where the content of W exceeds 0.5%, the effect of the added W is saturated, and the costs increase. In addition, an excessive amount of carbides are formed; and thereby, recrystallization and the like are delayed. As a result, anisotropy in workability is increased. Therefore, the upper limit of the content of W is set to 0.5%.

Cr: 0.01% to 2.0%

Cr is effective for strengthening the steel plate, particularly, Cr can be used as an alternative element which is an alternative to Mn, and Cr may be added as a selective element. However, in the case where the content of Cr is less than 0.01%, the effect is not exhibited. In the case where the content of Cr exceeds 2.0%, the effect is saturated in the present embodiment. Therefore, the content of Cr is set to be in a range of 0.01% to 2.0%. The content of Cr is preferably in a range of more than 0.1% to 1.5%, and more preferably in a range of more than 0.3% to 1.1%.

Ni: 0.01% to 1.0%

Ni is effective for the toughness and strengthening of the steel plate, and Ni may be added as a selective element. However, in the case where the content of Ni is less than 0.01%, the effect is not exhibited. In the case where the content of Ni exceeds 1.0%, the effect is saturated in the present embodiment. Therefore, the content of Ni is set to be in a range of 0.01% to 1.0%.

Cu: 0.01% to 1.0%

Similarly to Cr and Ni, Cu is effective for securing the strength of the steel plate, and Cu may be added as a selective element. However, in the case where the content of Cu is less than 0.01%, the effect is not exhibited. In the case where the content of Cu exceeds 1.0%, the effect is saturated in the present embodiment. Therefore, the content of Cu is set to be in a range of 0.01% to 1.0%.

Mo: 0.005% to 0.5%

Mo is an effective element for strengthening of the structure and improvement in toughness, and Mo may be added as a selective element. In the case where the content of Mo is less than 0.001%, the effect is small. In addition, in the case where the content of Mo exceeds 0.5%, the effect is saturated in the present embodiment. Therefore, the content of Mo is set to be in a range of 0.005% to 0.5%.

B: 0.0001% to 0.01%

B improves hardenability when B is added at a small content. In addition, B is an effective element for suppressing pearlite transformation so as to reduce the amount of pearlite bands, and B may be added according to necessity. In the case where the content of B is less than 0.0001%, the effect of the added B is not exhibited; and therefore, the lower limit of the content of B is set to 0.0005%. In addition, in the case where the content of B exceeds 0.01%, forgeability degrades; and thereby, cracking is caused in the slab. Therefore, the upper limit of the content of B is set to 0.01%. The content of B is preferably in a range of 0.0005% to 0.005%.

Mg: 0.0005% to 0.003%

Mg is an effective element for controlling configurations of oxides and sulfides when Mg is added at a small content, and Mg may be added according to necessity. In the case where the content of Mg is less than 0.0005%, the effect cannot be obtained. In addition, in the case where the content of Mg exceeds 0.003%, the effect is saturated. Therefore, the content of Mg is set to be in a range of 0.0005% to 0.003%.

Ca: 0.0005% to 0.003%

Similarly Mg, Ca is an effective element for controlling the configurations of oxides and sulfides when Ca is added at a small content, and Ca may be added according to necessity. In the case where the content of Ca is less than 0.0005%, the effect cannot be obtained. In addition, in the case where the content of Ca exceeds 0.003%, the effect is saturated. Therefore, the content of Ca is set to be in a range of 0.0005% to 0.003%.

Y: 0.001% to 0.03%

Similarly to Ca and Mg, Y is an effective element for controlling the configurations of oxides and sulfides, and Y may be added according to necessity. In the case where the content of Y is less than 0.001%, the effect cannot be obtained. In addition, in the case where the content of Y exceeds 0.03%, the effect is saturated, and the forgeability deteriorates. Therefore, the content of Y is set to be in a range of 0.001% to 0.03%.

Zr: 0.001% to 0.03%

Similarly to Y, Ca, and Mg, Zr is an effective element for controlling the configurations of oxides and sulfides, and Zr may be added according to necessity. In the case where the content of Zr is less than 0.001%, the effect cannot be obtained. In addition, in the case where the content of Zr exceeds 0.03%, the effect is saturated, and the forgeability deteriorates. Therefore, the content of Zr is set to be in a range of 0.001% to 0.03%.

La: 0.001% to 0.03%

Similarly to Zr, Y, Ca, and Mg, La is an effective element for controlling the configurations of oxides and sulfides, and La may be added according to necessity. In the case where the content of La is less than 0.001%, the effect cannot be obtained. In addition, in the case where the content of La exceeds 0.03%, the effect is saturated, and the forgeability deteriorates. Therefore, the content of La is set to be in a range of 0.001% to 0.03%.

Ce: 0.001% to 0.03%

Similarly to La, Zr, Y, Ca, and Mg, Ce is an effective element for controlling the configurations of oxides and sulfides, and Ce may be added according to necessity. In the case where the content of Ce is less than 0.001%, the effect cannot be obtained. In addition, in the case where the content of Ce exceeds 0.03%, the effect is saturated, and the forgeability deteriorates. Therefore, the content of Ce is set to be in a range of 0.001% to 0.03%.

Other components will not be specifically defined; however, there are cases in which elements of Sn, Sb, Zn, Zr, As, and the like incorporate from a scrap of a raw material as inevitable impurities. However, the characteristics of the hot-rolled steel plate are not greatly affected in the present embodiment at a level of the content at which the above-described elements incorporate as impurities.

(Plate Thickness)

The plate thickness of the hot-rolled steel plate of the present embodiment is set to be in a range of 2 mm to 25 mm in consideration of the configuration applied to plate press forging. In the case where the plate thickness is less than 2 mm, it becomes difficult to work (process) the steel plate in a thickening step or the like in plate forging; and therefore, the steel plate becomes inferior in plate press forging properties. In the case where the plate thickness exceeds 25 mm, a pressing load increases. In addition, it becomes liable to impose limitations on a facility that is used for cooling control, coiling, and the like in the production method of the present embodiment. Therefore, the upper limit of the plate thickness is set to 25 mm.

(Microstructure)

An area percentage of the pearlite bands is in a range of not more than the K value represented by the following formula in a region of 4/10t to 6/10t when a plate thickness is indicated by t in a cross section of a plate thickness that is parallel to a rolling direction.

$$K\ \text{value}=25.5\times C\%+4.5\times Mn\%-6$$

In the case where the hot-rolled steel plate contains Cr, the area percentage of the pearlite bands is not more than the K' value represented by the following formula instead of "not more than the K value".

$$K'\ value=15\times C\%+4.5\times Mn\%+3.2\times Cr\%-3.3$$

The pearlite band refers to an aggregate of pearlite phases having thicknesses of 5 μm or more in the plate thickness direction, and the aggregate is a band-shaped aggregate in which the pearlite phases are arranged in the rolling direction at intervals of 20 μm or less, and a length of the band-shaped aggregate in the rolling direction is in a range of 1 mm or longer.

Figure 8:
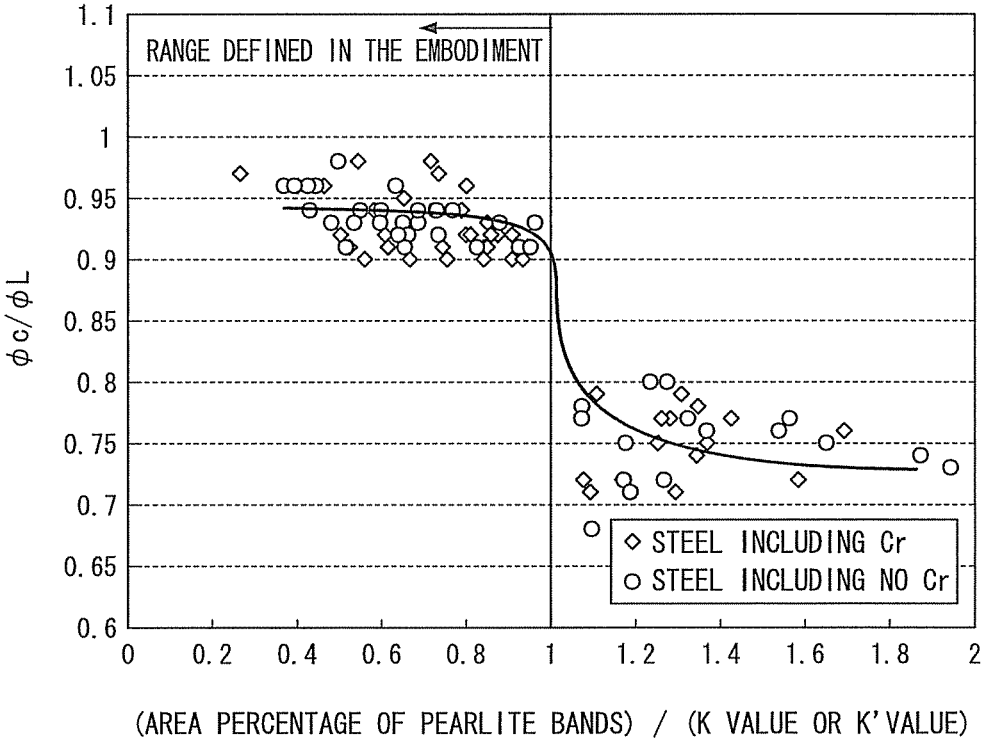
FIG. 8 is a view showing a relationship between ratios of (an area percentage of pearlite bands)/(K value or K' value) and anisotropies (ϕc/ϕL) in ultimate deformability.

FIG. 8 is a view showing a relationship between ratios of (the area percentage of the pearlite bands)/(the K value or the K' value) and anisotropies (φc/φL) in ultimate deformability. As shown in FIG. 8, it is found that, in the case where the ratio of (the area percentage of the pearlite bands)/(the K value or the K' value) is 1 or less, that is, in the case where the area percentage of the pearlite bands is not more than the K value or not more than the K' value, the anisotropy in ultimate deformability becomes 0.9 or more; and therefore, the anisotropies in workability in the rolling direction and in the direction perpendicular thereto can be reduced.

The area percentage of the pearlite bands is preferably in a range of 4.6% or less. In this case, the anisotropy in ultimate deformability becomes 0.9 or more as shown in FIGS. 3 and 4; and therefore, the anisotropy in workability can be decreased reliably.

[Method for Producing the Steel Plate for Cold Forging According to the First Embodiment]

As described above, the steel plate for cold forging according to the first embodiment is composed of the hot-rolled steel plate. The method for producing the hot-rolled steel plate will be described below.

The method for producing the hot-rolled steel plate includes: heating a slab; subjecting the heated slab to rough rolling so as to make a rough bar, subjecting the rough bar to finishing rolling so as to make a rolled material; after the finishing rolling, subjecting the rolled material to air cooling; cooling the rolled material to a coiling temperature; and coiling the cooled rolled material so as to make a hot-rolled steel plate.

(Step of Heating a Slab)

A slab (continuously cast slab or steel ingot) having the above-described chemical components of the present embodiment is directly inserted to a heating furnace, or the slab is cooled once, and then the slab is inserted to the heating furnace. Thereafter, the slab is heated at a temperature of 1150° C. to 1300° C.

In the case where the heating temperature is lower than 1150° C., a rolling temperature during hot rolling in the subsequent step lowers. Thereby, recrystallization behaviors during rough rolling and recrystallization behaviors during air cooling after continuous hot rolling do not progress; and as a result, extended grains remain, or anisotropy in workability increases. Therefore, the lower limit of the heating temperature is set to 1150° C. or higher. In the case where the heating temperature exceeds 1300° C., crystal grains coarsen during the heating; and thereby, anisotropy in workability increases. Therefore, the heating temperature is in a range of 1150° C. to 1300° C., and preferably in a range of 1150° C. to 1250° C.

Meanwhile, the heated slab (continuously cast slab or steel ingot) is subjected to the hot rolling in the subsequent step, and there is little difference in the characteristics of the steel plate between the case in which the slab is directly inserted to the heating furnace and the case in which the slab is cooled once and then inserted to the heating furnace. In addition, the hot rolling in the subsequent step may be either one of ordinary hot rolling or continuous hot rolling in which a rough bar is joined in finishing rolling, and there is little difference in the characteristics of the steel plate.

(Step of Rough Rolling)

Rough rolling includes a first rolling and a second rolling that is carried out 30 seconds or more after an end of the first rolling. The first rolling is carried out under conditions where a temperature is in a range of 1020° C. or higher and a sum of rolling reduction rates is in a range of 50% or more. The second rolling is carried out under conditions where a temperature is in a range of 1020° C. or higher and a sum of rolling reduction rates is in a range of 15% to 30%.

The pearlite bands are generated due to segregation of alloy elements such Mn, P, and the like. Therefore, it is effective to suppress uneven distribution of the alloy elements (to reduce a proportion of uneven distribution of the alloy elements) in order to reduce an area fraction (area percentage) of the pearlite bands. In the related art, as a method for suppressing the uneven distribution of the alloy elements, a process was carried out in which the slab (billet) was heated at a high temperature for a long time before hot rolling. In this process of the related art, the productivity degrades, and the costs increase. Furthermore, the amount of energy consumption becomes significant, and an increase in an amount of generated $CO_2$ is caused.

The inventors paid attention to the fact that diffusion of the alloy elements is promoted through work strains or grain boundary migration. As a result, the inventors found that the alloy elements are diffused by controlling conditions of the rough rolling as follows; and thereby, the uneven distribution of the alloy elements can be suppressed.

Firstly, the first rolling is carried out under conditions where a temperature is in a range of 1020° C. or higher and a sum of rolling reduction rates (total rolling reduction rate) is in a range of 50% or more. Thereby, dislocation density is increased, and in addition, diffusion of the alloy elements is promoted due to grain boundary migration which is caused by recrystallization of austenite. The upper limit of the temperature of the first rolling is preferably 1200° C. In the case where the temperature exceeds 1200° C., the slab becomes liable to be decarburized, which is not preferable. The sum of the rolling reduction rates (total rolling reduction rate) of the first rolling is preferably in a range of 60% or more, and more preferably in a range of 70% or more. The upper limit of the sum of the rolling reduction rates (total rolling reduction rate) is preferably 90%. In the case where the sum of the rolling reduction rates (total rolling reduction rate) exceeds 90%, it becomes difficult to terminate the rolling at a temperature of 1020° C. or higher, which is not preferable.

Next, the second rolling is carried out at the time when 30 seconds or more pass after the end of the first rolling. The second rolling is carried out under conditions where a temperature is in a range of 1020° C. or higher and a sum of the rolling reduction rates (total rolling reduction rate) is in a range of 15% to 30%. Thereby, recrystallized austenite grains grow, and the alloy elements are pulled by migrating grain boundaries so that the alloy elements diffuse. The elapsed time from the end of the first rolling to the beginning of the second rolling is preferably in a range of 45 seconds or more, and more preferably in a range of 60 seconds or more. The upper limit of the temperature of the second rolling is preferably 1200° C. In the case where the temperature exceeds 1200° C., the slab becomes liable to be decarburized, which is not preferable.

Meanwhile, the number of times that each of the first rolling and the second rolling that is carried out is not particularly limited. The first rolling and the second rolling may be carried out once respectively, or may be carried out two or more times respectively, as long as the rolling temperatures, the sums of the rolling reduction rates (total rolling reduction rates), and the elapsed time from the end of the first rolling to the beginning of the second rolling are within the above-described ranges. In any of these cases, the same effects can be obtained.

(Step of Finishing Rolling)

The rough bar that is obtained through the rough rolling is subjected to finishing rolling under a conditions where a finishing temperature is in a range of $Ae_3$ or higher.

The $Ae_3$ is a value calculated from the following formula.

$$Ae_3(^\circ\text{C.})=910-372\times C\%+29.8\times Si\%-30.7\times Mn\%+776.7\times P\%-13.7\times Cr\%-78.2Ni\%$$

(Here, C %, Si %, Mn %, P %, Cr %, and Ni % represent the contents (% by mass) of C, Si, Mn, P, Cr, and Ni included in the hot-rolled steel plate, respectively.)

In the case where the temperature of the finishing rolling (finishing temperature, the end temperature of the finishing rolling) is set to be in a range of $Ae_3$ or higher, recrystallization is promoted. Generally, the $Ae_3$ is used as a rough standard of the end temperature of the finishing rolling. In the case where the end temperature of the finishing rolling is $Ae_3$, the finishing rolling is terminated in a state of being austenite structure. However, the austenite structure is in an overcooling state, and the recrystallization does not occur sufficiently; and as a result, an increase in anisotropy in workability is promoted. Therefore, in the present embodiment, the finishing temperature (the end temperature of the finishing rolling) is set to be in a range of $Ae_3$ or higher.

(Step of Air Cooling)

After the finishing rolling, the rolled material is subjected to air cooling for 1 second to 10 seconds. In the case where the air-cooling time exceeds 10 seconds, the temperature lowers greatly; and thereby, recrystallization behaviors progress at a slow rate. Therefore, the effect of improving anisotropy in workability is saturated.

(Step of Cooling and Coiling after Air Cooling)

After the air cooling, the rolled material is cooled to a coiling temperature of 400° C. to 580° C. at a cooling rate of 10° C./s to 70° C./s. In the case where the cooling rate is less than 10° C./s, coarse ferrite and a coarse pearlite structure are formed. Therefore, deformability degrades due to the coarse pearlite structure even when the above-described hot rolling (the coarse rolling and the finishing rolling) is carried out. Therefore, the lower limit of the cooling rate is set to 10° C./s or more. In addition, in the case where the cooling rate exceeds 70° C./s, the steel plate is cooled unevenly in the width direction. Particularly, portions at or in the vicinities of edges are cooled excessively; and thereby, the portions are hardened. As a result, variation in quality of material is caused. Therefore, it becomes necessary to add an additional step such as trimming of the edges; and thereby, the yield is lowered. Therefore, the upper limit of the cooling rate is set to 70° C. or less.

Next, the cooled rolled material is coiled at a coiling temperature of 400° C. to 580° C. In the case where the coiling temperature is lower than 400° C., martensite transformation occurs in some portions of the steel plate, or the strength of the steel plate increases. As a result, workability degrades. In addition, it becomes difficult to handle the steel plate during uncoiling. On the other hand, in the case where the coiling temperature exceeds 580° C., C (carbon) discharged during ferrite transformation concentrates in austenite; and thereby, a coarse pearlite structure is generated. Since the coarse pearlite structure promotes generation of pearlite bands, the area percentage of the pearlite bands increases. As a result, deformability degrades, and anisotropy in workability increases.

In the case where the coiling temperature is set to be in a range of 580° C. or lower, the structure is miniaturized, and generation of the coarse pearlite structure is suppressed. As a result, degradation of deformability and an increase in anisotropy in workability can be suppressed.

(Second Embodiment)

[Steel Plate for Cold Forging According to the Second Embodiment]

Figure 6:
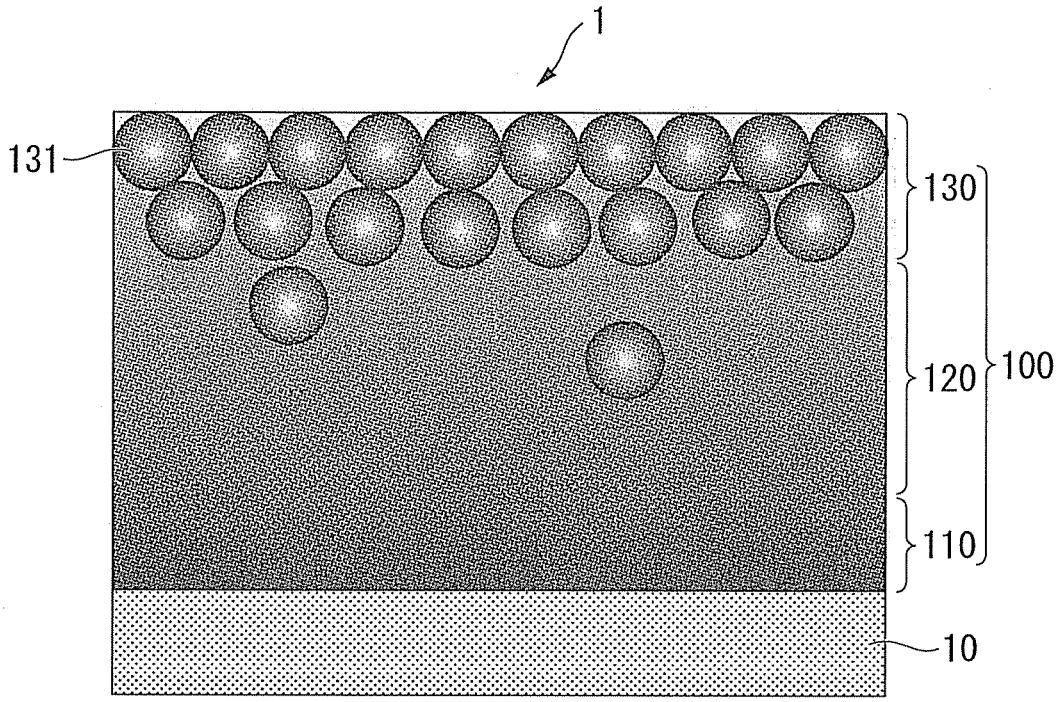
FIG. 6 is an explanatory view schematically showing a configuration of a steel plate for cold forging according to a second embodiment.

Firstly, the configuration of the steel plate for cold forging according to the second embodiment will be described with reference to FIG. 6. FIG. 6 is an explanatory view schematically showing the steel plate for cold forging according to the second embodiment.

As shown in FIG. 6, the steel plate for cold forging 1 according to the second embodiment includes: a hot-rolled steel plate 10 which is a base material; and a surface-treated film 100 formed on either one or both of main surfaces of the hot-rolled steel plate 10.

(Hot-rolled Steel Plate (a Main Body Portion of the Steel Plate, a Base Material) 10)

The hot-rolled steel plate 10 which serves as the base material of the steel plate for cold forging 1 is the hot-rolled steel plate as described in the first embodiment. Therefore, detailed description of the hot-rolled steel plate 10 will not be made.

(Surface-treated Film 100)

The surface-treated film 100 has a concentration gradient of each component of the film in a film thickness direction; and thereby, the film has a concentration-gradient type three-layer structure in which three layers of an adhesion layer 110, a base layer 120, and a lubricant layer 130 are identifiably situated in series from a side of an interface between the surface-treated film 100 and the hot-rolled steel plate 10 towards a surface side of the surface-treated film 100.

Here, the "concentration-gradient type" in the present embodiment does not refer to a fact that the respective layers of the adhesion layer 100, the base layer 120, and the lubricant layer 130 which are included in the surface-treated film 100 are completely separated and divided into three layers (the components of one layer are not present in other layers), but means that, as described above, the components included in the surface-treated film 100 have concentration gradients in the film thickness direction. That is, main components in the surface-treated film 100 include a component originating from a silanol bond (the details will be described below) formed between a metal in the surface of the hot-rolled steel plate 10 which is the base material and the surface-treated film, a high-temperature resin (heat-resistant resin), an inorganic acid salt, and a lubricant. Each of the components has a concentration gradient in the film thickness direction of the surface-treated film 100. In more detail, a concentration of the lubricant 131 increases, and, conversely, concentrations of the high-temperature resin and the inorganic acid salt decrease, from the side of the interface between the surface-treated film 100 and the hot-rolled steel plate 10 toward the surface side of the surface-treated film 100. In addition, a concentration of the component originating from the silanol bond increases toward the vicinity of the interface between the surface-treated film 100 and the hot-rolled steel plate 10.

Hereinafter, configurations of the respective layers that constitute the surface-treated film 100 will be described in detail.

<Adhesion Layer 110>

The adhesion layer 110 secures adhesion properties between the surface-treated film 100 and the hot-rolled steel plate 10 which is the base material with respect to working during cold forging; and thereby, the adhesion layer 110 has roles of preventing seizure between the steel plate for cold forging 1 and a mold. Specifically, the adhesion layer 110 is situated on a side of an interface between the surface-treated film 100 and the hot-rolled steel plate 10, and the adhesion layer 110 is a layer that includes a largest amount of the component originating from the silanol bond among the three layers that compose the surface-treated film 100.

Here, the silanol bond in the present embodiment is represented by Si—O—X (X represents a metal that is a component of the hot-rolled steel plate), and the silanol bond is formed at or in the vicinity of the interface between the surface-treated film 100 and the hot-rolled steel plate 10. The silanol bond is assumed to be a covalent bond between a silane coupling agent included in a surface treatment fluid for forming the surface-treated film 100 and an oxide of the metal in the surface of the hot-rolled steel plate 10 (the metal is for example, a kind of metal (Zn, Al, or the like) used in plating in the case where the hot-rolled steel plate 10 is subjected to plating, or Fe in the case where the hot-rolled steel plate 10 is a non-plated steel plate). In addition, the presence of the silanol bond can be confirmed by a method which is capable of conducting elemental analysis in a depth direction of a test specimen. For example, spectrum intensities of component elements (Si, O, and X) originating from the silanol bond in a film thickness direction of the surface-treated film 100 are measured by a high-frequency glow-discharge optical emitting spectroscopic apparatus (high-frequency GDS), and then contents of the respective elements are determined from the spectrum intensities. Thereby, the presence of the silanol bond can be confirmed. In addition, the presence of the silanol bond can also be confirmed through direct observation of a cross section of a test specimen using a field emission transmission electron microscope (FE-TEM) or the like, or the presence of the silanol bond can be confirmed through a microanalysis of elements (for example, an analysis method by using an energy dispersive X-ray spectrometer (EDS)), or the like.

In addition, a thickness of the adhesion layer 110 needs to be in a range of 0.1 nm to 100 nm. In the case where the thickness of the adhesion layer 110 is less than 0.1 nm, the forming of the silanol bond is not sufficient; and thereby, a sufficient adhering force between the surface-treated film 100 and the hot-rolled steel plate 10 cannot be obtained. On the other hand, in the case where the thickness of the adhesion layer 110 exceeds 100 nm, a number of the silanol bonds are excessively large; and thereby, internal stress in the adhesion layer 110 increases during working of the steel plate for cold forging 1, and the film becomes brittle. Therefore, the adhering force between the surface-treated film 100 and the hot-rolled steel plate 10 degrades. The thickness of the adhesion layer 110 is preferably in a range of 0.5 nm to 50 nm from the viewpoint of securing the adhering force between the surface-treated film 100 and the hot-rolled steel plate 10 more reliably.

<Base Layer 120>

The base layer 120 has a role of improving the tracking of the steel plate (followability) during cold forging. In addition, the base layer 120 holds the lubricant 131; and thereby, the base layer 120 has a role of supplying the steel plate for cold forging 1 with hardness and strength with respect to seizure between the steel plat and the mold. Specifically, the base layer 120 is situated as an intermediate layer between the adhesion layer 110 and the lubricant layer 130, and the base layer 120 includes largest amounts of the high-temperature resin and the inorganic acid salt as main components among the three layers that compose the surface-treated film 100. In detail, the base layer 120 has the largest contents of the high-temperature resin and the inorganic acid salt included in the whole layer among the three layers.

A reason why the inorganic acid salt is selected as the component mainly included in the base layer 120 is as follows. The inorganic acid salt can form a film of a concentration-gradient type three-layer structure in the present embodiment, and the inorganic acid salt is appropriate for playing the above-described role of the base layer 120. Meanwhile, in the present embodiment, the surface-treated film 100 is formed using a water-based surface treatment fluid. Therefore, the inorganic acid salt in the present embodiment is preferably water-soluble in consideration of the stability of the surface treatment fluid. However, even when a salt is insoluble or rarely soluble in water, the salt can be used if soluble in an acid. For example, a film including zinc phosphate can be formed by using a combination of a water-soluble inorganic acid salt (for example, zinc nitrate), and an acid (for example, phosphate).

In terms of the above-described roles, examples of the inorganic acid salt that can be used in the present embodiment include phosphate, borate, silicate, molybdate, tungstate, or combinations of a plurality of the above-described salts. Specifically, examples of the inorganic acid salt that can be used include zinc phosphate, calcium phosphate, sodium borate, potassium borate, ammonium borate, potassium silicate, potassium molybdate, sodium molybdate, potassium tungstate, sodium tungstate, and the like. However, among the above-described salts, the inorganic acid salt is particularly preferably at least one kind of compound selected from a group consisting of phosphate, borate, and silicate for reasons of expediency (convenience) when the thicknesses of the respective layers of the adhesion layer 100, the base layer 120, and the lubricant layer 130 are measured.

In addition, the base layer 120 includes the high-temperature resin as a main component. As described above, during cold forging, the temperature becomes relatively high due to the friction force between the steel plate for cold forging 1 which is a base material and the mold. Therefore, a reason why the high-temperature resin is selected is that the surface-treated film 100 needs to maintain a film shape even under working conditions of such a high temperature. From the above-described viewpoint, heat resistance of the high-temperature resin in the present embodiment is preferably favorable enough to hold a film shape at a temperature of higher than the achieving temperature (approximately 200° C.) during cold forging. Meanwhile, in the present embodiment, the surface-treated film 100 is formed using a water-based surface treatment fluid. Therefore, the high-temperature resin in the present embodiment is preferably water-soluble in consideration of the stability of the surface treatment fluid.

In terms of the above-described roles, examples of the high-temperature resin that can be used in the present embodiment include a polyimide resin, a polyester resin, an epoxy resin, a fluororesin, and the like. In particular, in order to secure sufficient heat resistance and water solubility, a polyimide resin is preferably used as the high-temperature resin.

In addition, the composition of the base layer 120 also has an influence on the entire composition of the steel plate for cold forging 1. Therefore, in the present embodiment, the high-temperature resin is used as a main component of the base layer 120 in order to confer work tracking and heat resistance of the surface-treated film 100, and for example, like Patent Document 4, an inorganic component such as phosphate, borate, silicate, molybdate, tungstate, or the like is not used as a main component. Specifically, an amount of the inorganic acid salt in the base layer 120 is in a range of 1 part by mass to 100 parts by mass with respect to 100 parts by mass of the high-temperature resin. In the case where the amount of the inorganic acid salt is less than 1 part by mass, a friction coefficient of the surface-treated film 100 increases; and thereby, sufficient lubricity cannot be obtained. On the other hand, in the case where the amount of the inorganic acid salt exceeds 100 parts by mass, performance for holding the lubricant 131 is not sufficiently exhibited.

In addition, a thickness of the base layer 120 needs to be in a range of 0.1 μm to 15 μm. In the case where the thickness of the base layer 120 is less than 0.1 μm, the performance for holding the lubricant 131 is not sufficiently exhibited. On the other hand, in the case where the thickness of the base layer 120 exceeds 15 μm, the film thickness of the base layer 120 is excessively thick; and thereby, pressing scratch or the like becomes liable to occur during working (cold forging). The thickness of the base layer 120 is preferably in a range of 0.5 μm or more from the viewpoint of improving the performance for holding the lubricant 131, and the thickness of the base layer 120 is preferably in a range of 3 μm or less from the viewpoint of more reliably preventing the pressing scratch during working <Lubricant Layer 130>

The lubricant layer 130 has a role of improving lubricity of the surface-treated film 100 so as to reduce a friction coefficient. Specifically, the lubricant layer 130 is situated on an outermost surface side of the surface-treated film 100, and the lubricant layer 130 is a layer which includes a largest amount of the lubricant 131 among the three layers that compose the surface-treated film 100.

In the present embodiment, the lubricant 131 is not particularly limited as long as the lubricant can form the surface-treated film 100 having a concentration-gradient type three-layer structure and the lubricant sufficiently improves the lubricity of the surface-treated film 100. For example, it is possible to use at least one kind selected from a group consisting of polytetrafluoroethylene, molybdenum disulfide, tungsten disulfide, zinc oxide, and graphite.

In addition, a thickness of the lubricant layer 130 needs to be in a range of 0.1 μm to 10 μm. In the case where the thickness of the lubricant layer 130 is less than 0.1 μm, sufficient lubricity cannot be obtained. On the other hand, in the case where the thickness of the lubricant layer 130 exceeds 10 μm, redundant unwanted material is generated during working, and a disadvantage occurs in which the redundant unwanted material attaches to the mold or the like. The thickness of the lubricant layer 130 is preferably in a range of 1 μm or more from the viewpoint of further improving the lubricity. In addition, the thickness of the lubricant layer 130 is preferably in a range of 6 μm or less from the viewpoint of more reliably preventing generation of the redundant unwanted material during working Furthermore, in order to play the roles of the base layer 120 and the lubricant layer 130, a thickness ratio between the lubricant layer 130 and the base layer 120 is also important. Specifically, a ratio of the thickness of the lubricant layer 130 to the thickness of the base layer 120, that is, (the thickness of the lubricant layer)/(the thickness of the base layer) needs to be in a range of 0.2 to 10. In the case where (the thickness of the lubricant layer)/(the thickness of the base layer) is less than 0.2, the surface-treated film 100 is hardened excessively throughout the film; and thereby, the lubricity cannot be sufficiently obtained. On the other hand, in the case where (the thickness of the lubricant layer)/(the thickness of the base layer) exceeds 10, the holding properties of the lubricant 131 deteriorate, and the work tracking lacks throughout the film.

<A method for confirming whether or not the layers are formed, a method for measuring and defining the film thicknesses of the respective layers, and a method for measuring the amounts of the high-temperature resin and the inorganic acid salt in the base layer>

As described above, in the steel plate for cold forging 1 according to the present embodiment, it is important that the adhesion layer 110 is present on the side of the hot-rolled steel plate 10, the lubricant layer 130 is present on the film surface side, and the base layer 120 is present therebetween. The lubricity that can tolerate cold forging, which is intended in the present embodiment, cannot be exhibited if any one of the layers is not present. In addition, even in the case where the thicknesses of the respective layers of the adhesion layer 110, the base layer 120, and the lubricant layer 130 are not within the above-described ranges, the lubricity that can tolerate cold forging, which is intended in the present embodiment, cannot be exhibited. Therefore, in the present embodiment, a method for confirming whether or not the respective layers of the adhesion layer 110, the base layer 120, and the lubricant layer 130 are formed, and a method for measuring the film thicknesses become important.

Firstly, examples of the method for confirming whether or not the respective layers of the adhesion layer 110, the base layer 120, and the lubricant layer 130 are formed include a method in which quantitative analysis of elements are carried out in the film thickness direction (depth direction) of the surface-treated film 100 using a high-frequency GDS. That is, firstly, representative elements (characteristic elements in the components) of the main components (the component originating from the silanol bond, the inorganic acid salt, the high-temperature resin, and the lubricant) included in the surface-treated film 100 are set. For example, with regard to the component originating from the silanol bond, Si is set as the representative element. With regard to the lubricant, appropriately, F is set as the representative element in the case where the lubricant is polytetrafluoroethylene, and Mo is set as the representative element in the case where the lubricant is molybdenum disulfide. Next, intensities of peaks that correspond to these representative elements are obtained in a measurement chart of the high-frequency GDS. Concentrations of the respective components at each location in the film thickness direction can be calculated from the obtained peak intensities.

The method for measuring the thicknesses of the respective layers in the present embodiment is defined as below. Firstly, a depth (a location in the film thickness direction) of a portion having a peak intensity of half the maximum value of the peak intensity of the representative element (for example, F, Mo, W, Zn, and C) of the lubricant, which is set in the above-described manner, from the outermost surface of the surface-treated film 100 in the measurement chart of the high-frequency GDS is considered as the thickness of the lubricant layer 130. That is, the location in the film thickness direction of the portion having a peak intensity of half the maximum value of the peak intensity of the representative element of the lubricant serves as an interface between the lubricant layer 130 and the base layer 120.

In addition, a depth (a location in the film thickness direction) of a portion having a peak intensity of half the maximum value of the peak intensity of the representative element (Si) of the component originating from the silanol bond, from the interface between the surface-treated film 100 and the hot-rolled steel plate 10 in the measurement chart of the high-frequency GDS is considered as the thickness of the adhesion layer 110. That is, the location in the film thickness direction of the portion having a peak intensity of half the maximum value of the peak intensity of the representative element (Si) of the component originating from the silanol bond serves as an interface between the adhesion layer 110 and the base layer 120.

Furthermore, the thickness of the base layer 120 is defined as a depth from the portion having a peak intensity of half the maximum value of the peak intensity of the representative element of the lubricant to the portion having a peak intensity of half the maximum value of the peak intensity of the representative element (Si) of the component originating from the silanol bond. Meanwhile, for example, the thickness of the base layer 120 may be obtained as follows. The thickness of the entire surface-treated film 100 is measured from a cross section of the surface-treated film 100 observed using a microscope, and then a sum of the thickness of the adhesion layer 110 and the thickness of the lubricant layer 130 which are obtained in the above-described manner is subtracted from the thickness of the entire surface-treated film 100.

However, in the case where graphite is used as the lubricant 131, when carbon (C) is set as the representative element, it is difficult to differentiate the carbon from the C element derived from the high-temperate resin and the like. Therefore, the thickness of the lubricant layer 130 is measured using the representative element (for example, P, B, or Si) of the inorganic acid salt component. Even in this case, the location in the film thickness direction of a portion having a peak intensity of half the maximum value of the peak intensity of the representative element of the inorganic acid salt component serves as the interface between the lubricant layer 130 and the base layer 120.

In addition, in the case where silicate is used as the inorganic acid salt of the base layer 120, when silicon (Si) is set as the representative element, it is difficult to differentiate Si derived from silicate as the inorganic acid salt from Si derived from the component originating from the silanol bond in the adhesion layer 110. Therefore, the thicknesses of the adhesion layer 110 and the base layer 120 are measured using the carbon (C) derived from the high-temperature resin component in the base layer 120 as the representative element.

Furthermore, in the case where molybdate or tungstate is used as the inorganic acid salt of the base layer 120, when molybdenum (Mo) or tungsten (W) is set as the representative element, there are cases in which it is difficult to differentiate Mo or W derived from the inorganic acid salt from Mo or W derived from the lubricant 131. In this case, the thicknesses of the base layer 120 and the lubricant layer 130 are measured using an element that the inorganic acid salt and the lubricant 131 do not have in common, for example, sulfur (S) derived from the lubricant 131 as the representative element.

Meanwhile, in the method for calculating the thicknesses of the respective layers, the locations of the respective layers in the film thickness direction of the surface-treated film 100 can be obtained from the locations of the portions having the peak intensities of half the maximum values of the peak intensities of the representative elements of the respective components, that is, sputtering times (in the case of the present embodiment, times converted into the sputtering rate of $SiO_2$) by the high-frequency GDS in the above-described manner.

The amounts of the high-temperature resin and the inorganic acid salt in the base layer are measured by the following method. The surface-treated film is cut in the thickness direction using a microtome or the like, and the base layer is cut out. A test specimen having an amount necessary for analysis is taken from the base layer, and the test specimen is crushed using an agate mortar. An initial weight of the test specimen for analysis is measured, and then, a solution that dissolves the inorganic acid salt, such as water, is added; and thereby, the inorganic acid salt is dissolved. The inorganic acid salt is dissolved, and then the test specimen for analysis is sufficiently dried. A weight of the dried test specimen for analysis is used as a mass (parts by mass) of the high-temperature resin, and a difference in the weight between the initial weight and the weight after drying is used as a mass (parts by mass) of the inorganic acid salt. Thereafter, the amount (parts by mass) of the inorganic acid salt with respect to the 100 parts by mass of the high-temperature resin 100 is calculated from the calculated amounts of the high-temperature resin and the inorganic acid salt in the base layer.

[A Method for Producing the Steel Plate for Cold Forging According to the Second Embodiment]

Thus far, the configuration of the steel plate for cold forging according to the second embodiment has been described in detail, and subsequently, a method for producing the steel plate for cold forging according to the second embodiment having the above-described configuration will be described.

The method for producing the steel plate for cold forging according to the second embodiment includes: obtaining a hot-rolled steel plate 10 by the method for producing the hot-rolled steel plate of the first embodiment; and forming a surface-treated film 100 on either one or both of main surfaces (a front surface and a rear surface) of the hot-rolled steel plate 10.

Since the step of obtaining the hot-rolled steel plate is the same as that in the first embodiment, explanation thereof will not be made.

The step of forming the surface-treated films 100 includes: coating a water-based surface treatment fluid including a water-soluble silane coupling agent, a water-soluble inorganic acid salt, a water-soluble high-temperature resin, and a lubricant on either one or both of the main surfaces of the hot-rolled steel plate 10 so as to form a coated film; and drying the coated film so as to form the surface-treated film 100 on either one or both of the main surfaces of the hot-rolled steel plate 10.

(Regarding the Surface Treatment Fluid)

The surface treated fluid that is used in the method for producing the steel plate for cold forging according to the present embodiment includes a water-soluble silane coupling agent, a water-soluble inorganic acid salt, a water-soluble high-temperature resin, and a lubricant. The details of the inorganic acid salt, the high-temperature resin, and the lubricant have been described, and thus explanation thereof will not be made.

The water-soluble silane coupling agent is not particularly limited, and a well-known silane coupling agent can be used. Examples thereof that can be used include 3-aminopropyltrimethoxy silane, N-2-(aminomethyl)-3-aminopropylmethyldimethoxy silane, 3-glycidoxypropyltrimethoxysilane, 3-glycidoxypropyltriethoxysilane, and the like.

In addition, a variety of additives may be added to the surface treatment fluid.

The surface treatment fluid that is used in the method for producing the steel plate for cold forging according to the present embodiment may contain a leveling agent for improving coating properties, a water-soluble solvent, a metal stabilizer, an etching suppressor, a pH adjuster, and the like at amounts within ranges in which the effects of the present embodiment are not impaired. Examples of the leveling agent include nonionic surfactants and cationic surfactants, and specifically, examples thereof that can be used include adducts of polyethylene oxides or polypropylene oxides, acetylene glycol compounds, and the like. Examples of the water-soluble solvent include: alcohols such as ethanol, isopropyl alcohol, t-butyl alcohol, and propylene glycol; cellosolves such as ethylene glycol monobutyl ether, and ethylene glycol monoethyl ether; esters such as ethyl acetate, and butyl acetate; ketones such as acetone, methyl ethyl ketone, methyl isobutyl ketone, and the like. Examples of the metal stabilizer include chelate compounds such as EDTA, DTPA, and the like. Examples of the etching suppressor include amine compounds such as ethylene diamine, triethylene pentamine, guanidine, pyridine, and the like. Particularly, compounds having two or more amino groups in a single molecule also have the effects of the metal stabilizer; and therefore, such compounds are more preferable. Examples of the pH adjuster include: organic acids such as acetic acid, and lactic acid; inorganic acids such as hydrofluoric acid; ammonium salts; amines, and the like.

The surface treatment fluid that is used in the method for producing the steel plate for cold forging according to the present embodiment can be prepared by evenly dissolving or dispersing the respective components in water.

(Coating and Drying of the Surface Treated Fluid)

Examples of the method for coating the surface treatment fluid on the hot-rolled steel plate 10 include a method in which the hot-rolled steel plate 10 is immersed in the surface treatment fluid. In this case, it is necessary to heat the hot-rolled steel plate 10 to a temperature higher than a temperature of the surface treatment fluid in advance, or in the alternative, it is necessary to dry the hot-rolled steel plate using warm air during drying. Specifically, the hot-rolled steel plate 10 is immersed in warm water at approximately 80° C. for approximately one minute, and then, the hot-rolled steel plate 10 is immersed in the surface treatment fluid at a temperature of approximately 40° C. to 60° C. for approximately one second. Thereafter, the hot-rolled steel plate is dried at room temperature for approximately 2 minutes. Thereby, the concentration-gradient type surface-treated film 100 having a three-layer structure composed of the adhesion layer 110, the base layer 120, and the lubricant layer 130 can be formed.

(Method for Controlling the Film Thicknesses of the Respective Layers)

The coated amount of the surface treatment fluid, the concentrations of the respective components in the surface treatment fluid, and reactivities and hydrophilicities/hydrophobicities of the surface treatment fluid and the hot-rolled steel plate 10 which is the base material are appropriately controlled. Thereby, the film thicknesses of the respective layers that compose the surface-treated film 100 can be adjusted to be within the above-described ranges of the film thicknesses.

(Reasons why the Concentration-gradient Type Film is Formed)

As described above, the surface treatment fluid in which the water-soluble silane coupling agent, the water-soluble inorganic acid salt, the water-soluble high-temperature resin, and the lubricant are dissolved or dispersed in water is coated on the hot-rolled steel plate 10, and then dried. Thereby, the concentration-gradient type surface-treated film 100 is formed. The inventors assumed that reasons why the concentration-gradient type surface-treated film 100 is formed are as follows.

Firstly, in the case where the hot-rolled steel plate 10 is heated to a temperature higher than the temperature of the surface treatment fluid in advance as described above, the temperature of the hot-rolled steel plate 10 is higher than the temperature of the surface treatment fluid. Therefore, in the coated film (thin film) formed by coating the surface treatment fluid on the hot-rolled steel plate 10, temperature of a solid-liquid interface is high; however, temperature of a gas-liquid interface becomes low. As a result, a difference in temperature occurs in the coated film (thin film); and thereby, water which serves as the solvent is volatilized such that fine convection occurs in the coated film (thin film).

In addition, in the case where the surface treatment fluid at room temperature is coated on the hot-rolled steel plate 10 at room temperature so as to form the coated film (thin film), and then the hot-rolled steel plate is dried using warm air, temperature of a gas-liquid interface becomes high, and a surface tension at the gas-liquid interface becomes low. Fine convection occurs in the coated film (thin film) in order to alleviate the above-described phenomenon.

In any of these coating and drying methods, convection occurs, and a component having a high affinity to air (for example, the lubricant) and components having high affinities to metal and water (for example, the inorganic acid salt and the high-temperature resin) are separated. Then, when water is gradually volatilized to form a film shape, a concentration-gradient type film having concentration gradients of the respective components is formed.

In addition, in the present embodiment, since the silane coupling agent has a high affinity to metal in the surface of the hot-rolled steel plate 10, the silane coupling agent diffuses to the vicinity of the hot-rolled steel plate 10 in the coated film (thin film). Then, it is considered that the silane coupling agent that reaches the vicinity of the hot-rolled steel plate 10 forms a covalent bond with a metal oxide present in the surface of the hot-rolled steel plate 10 (for example, zinc oxide in the case where the hot-rolled steel plate 10 is subjected to zinc plating); and thereby, the silanol bond represented by Si—O-M is formed. As such, the silanol bond is formed at or in the vicinity of the hot-rolled steel plate 10; and thereby, adhesion between the surface-treated film 100 and the hot-rolled steel plate 10 is extremely improved. Therefore, occurrence of seizure and galling is prevented.

The steel plate for cold forging according to the second embodiment as described above can be produced by a method which is composed of simple treatment steps and is preferable from the viewpoint of global environmental protection, and the steel plate for cold forging has excellent lubricity. Therefore, due to the recent environmental measures, cold forging is more commonly carried out rather than workings that involve large shape deformation, such as hot forging accompanied by large energy consumption and cutting work that causes a large amount of material loss. Even in the case where stricter plastic working or complicate working is demanded, the steel plate for cold forging can be worked without occurrence of seizure and galling between the steel plate and a mold or other problems.

Thus far, preferable embodiments of the present invention have been described in detail with reference to the accompanying drawings; however, the present invention is not limited to such examples. It is evident that a person having ordinary knowledge in the technical field to which the invention belongs can imagine a variety of modified examples and corrected examples within the scope of technical requirements as stated in the claims, and it is needless to say that such examples are considered to be in the technical scope of the present invention.

EXAMPLES

Next, examples of the embodiments will be described; however, conditions in the examples are one example of conditions which are employed to confirm the feasibility and effects of the embodiments, and the embodiments are not limited to the example of conditions. The embodiments can employ a variety of conditions within the features of the embodiments as long as the objects of the embodiments are achieved.

Example 1

50 kg of a steel ingot having the component composition as shown in Table 1 was melted in a laboratory through vacuum melting, and a hot-rolled steel plate having a thickness of 10 mm was produced under conditions that fulfilled the requirements as described in the first embodiment. A cross-sectional portion of a plate thickness in parallel with a rolling direction was taken from the hot-rolled steel plate. The cross-sectional portion was subjected to a polishing treatment, and then the cross-sectional portion was immersed in a Nital solution (a solution including approximately 5% of nitric acid with the remainder being alcohol); and thereby, pearlite emerged. Next, with regard to a central portion of the plate thickness in a region of 4/10t to 6/10t with respect to the plate thickness t, the structure was photographed using an optical microscope (at a 50-fold magnification, at a 100-fold magnification, and at a 200-fold magnification). The photos of the observed structure are shown in FIGS. 5A to 5C.

TABLE 1

| C | Si | Mn | P | S | Al | Cr | Nb | Ti | N | Coiling temperature (° C.) |
|---|---|---|---|---|---|---|---|---|---|---|
| 0.16 | 0.18 | 1.42 | 0.014 | 0.003 | 0.0032 | 0.03 | 0.04 | 0.001 | 0.0038 | 575 |

Figure 5A:
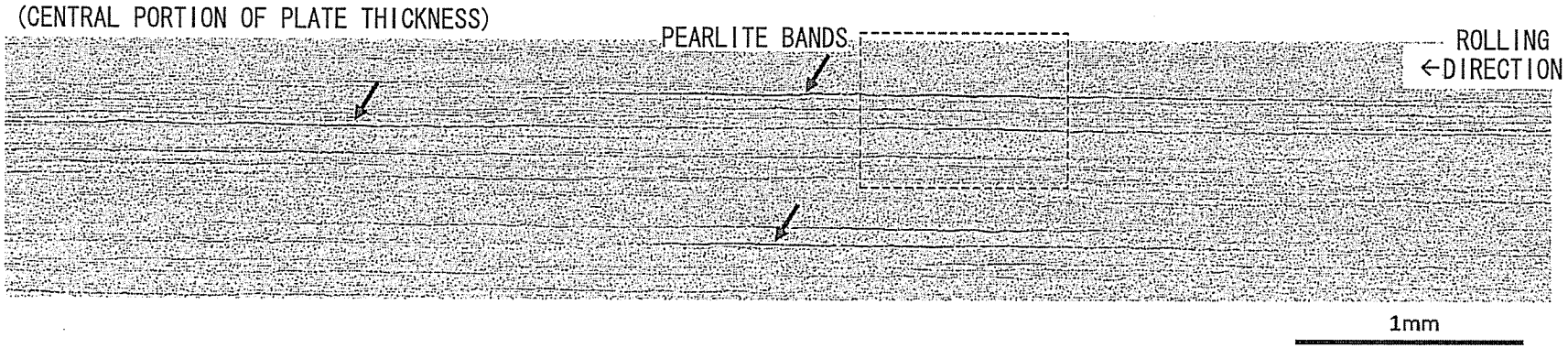
FIG. 5A is a micrograph (at 50-fold magnification) of a hot-rolled steel plate of Example 1.
Figure 5B:
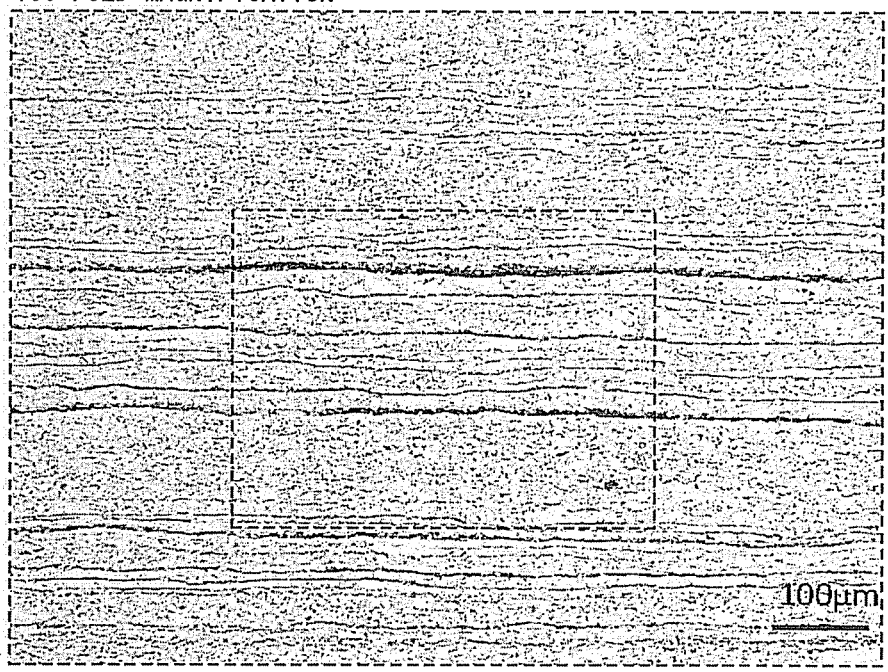
FIG. 5B is a micrograph of the hot-rolled steel plate of Example 1, and is a photograph of a dotted line region in FIG. 5A at 100-fold magnification.
Figure 5C:
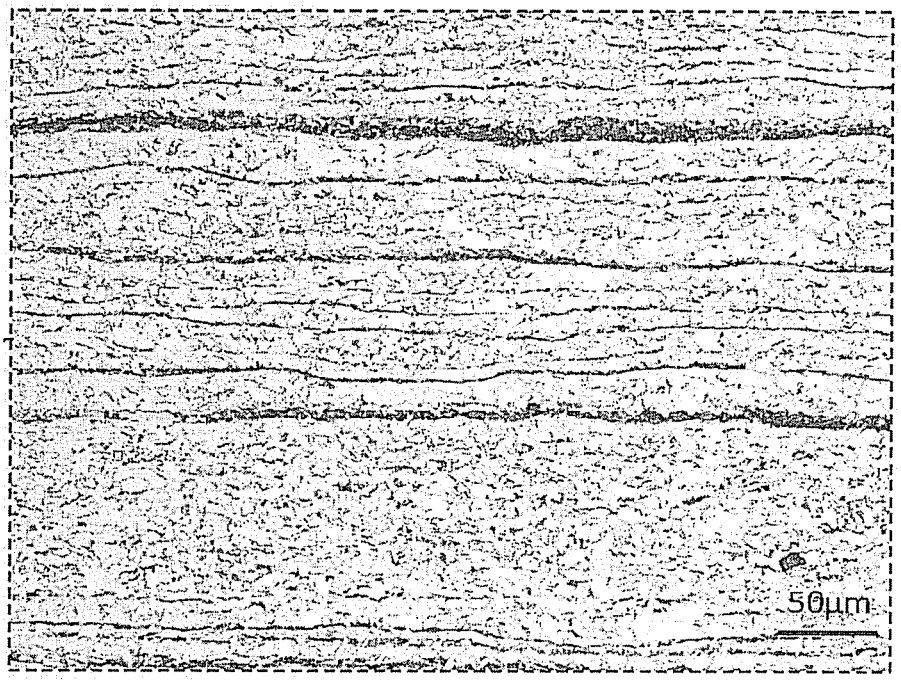
FIG. 5C is a micrograph of the hot-rolled steel plate of Example 1, and is a photograph of a dotted line region in FIG. 5B at 200-fold magnification.

From FIGS. 5A to 5C, pearlite bands having lengths of 1 mm or more could be confirmed. In the structure photo at a 100-fold magnification of FIG. 5B, the pearlite bands appear to be connected to each other without interspaces (intervals). In contrast, in the structure photo at a 200-fold magnification of FIG. 5C, interspaces (intervals) can be confirmed in the pearlite bands, and some of the pearlite bands appear to be separated. Generally, pearlite phases exist at grain boundaries of ferrite phases. In the examples, the pearlite band was defined as an aggregate of the pearlite phases scattered in the grain boundaries of the ferrite phases. In detail, the thicknesses of the respective pearlite phases that configured the aggregate in a plate thickness direction were in a range of 5 μm or more. The pearlite band was a band-shaped aggregate in which the pearlite phases were arranged in a rolling direction at intervals of 20 μm or less, and a length of the band-shaped aggregate in the rolling direction was in a range of 1 mm or longer.

An area percentage of the pearlite bands was measured by the following method. The structure photos photographed at a 100-fold magnification were connected with each other so as to make one piece of a structure image. Then, the structure image was subjected to image analysis using an image analysis software (WinROOF Ver. 5.5.0 manufactured by Mitani Corporation); and thereby, the area percentage of the recognized pearlite bands was measured.

Example 2

50 kg of a steel ingot having each of the component compositions as shown in Tables 2 to 5 was melted in the laboratory through vacuum melting, and a steel plate having a thickness of 10 mm was produced under each of the conditions as shown in Tables 6 to 8. Meanwhile, the chemical compositions of the test specimens in Tables 6 to 8 are the same as the chemical compositions of steel ingots having the same steel numbers as the test specimen numbers.

Samples for structure observation and round bar tension test specimens for ultimate deformability measurement were taken from the obtained steel plates.

An area fraction of pearlite bands having lengths of 1 mm or longer that were present in a region of 4/10t to 6/10t was measured by the method as determined in Example 1.

A round bar tension test specimen having a diameter of 8 mm was taken along a rolling direction from a central portion of the hot-rolled steel plate. Similarly, a round bar tension test specimen having a diameter of 8 mm was taken along a direction perpendicular to the rolling direction. Tension tests were carried out on the test specimens. Areas of broken portions after breakage were measured, and ultimate deformabilities were calculated from cross section shrinkage rates of the test specimens after the tests according to the formula of the ultimate deformability. When the ultimate deformability in the rolling direction was represented by $\phi L$, and the ultimate deformation in the direction perpendicular to the rolling direction was represented by $\phi c$, a ratio ($\phi c/\phi L$) was calculated. The area fractions of the pearlite bands and the ultimate deformability ratios which were obtained are shown in Tables 9 and 10.

Meanwhile, underlined numeric values in the tables indicate that they fail to meet the requirements as defined in the embodiments.

TABLE 2

| Steel | Components (% by mass) | | | | | | | | | | | Ae3 | A | K' | |
|---|---|---|---|---|---|---|---|---|---|---|---|---|---|---|---|
| No. | C | Si | Mn | P | S | Al | N | O | Cr | B | Others | (° C.) | value | value | Note |
| 1-1 | 0.13 | 0.14 | 0.53 | 0.01 | 0.0009 | 0.024 | 0.0033 | 0.0022 | 0.35 | 0.0012 | | 850 | 0.0039 | 2.16 | Invention steel |
| 1-2 | 0.16 | 0.08 | 0.65 | 0.01 | 0.0006 | 0.026 | 0.0027 | 0.0026 | 0.35 | 0.0016 | | 839 | 0.0041 | 3.15 | Invention steel |
| 1-3 | 0.18 | 0.19 | 0.35 | 0.02 | 0.0015 | 0.031 | 0.0022 | 0.0028 | 0.68 | 0.0022 | Nb: 0.028 | 846 | 0.0053 | 3.15 | Invention steel |
| 1-4 | 0.17 | 0.2 | 0.45 | 0.01 | 0.0008 | 0.029 | 0.0045 | 0.0017 | 0.45 | 0.0031 | Ti: 0.037 | 841 | 0.0035 | 2.72 | Invention steel |
| 1-5 | 0.13 | 0.22 | 0.65 | 0.01 | 0.0013 | 0.043 | 0.0032 | 0.0023 | 0.39 | 0.0026 | V: 0.018 | 853 | 0.0050 | 2.82 | Invention steel |
| 1-6 | 0.18 | 0.18 | 0.15 | 0.01 | 0.0025 | 0.021 | 0.0027 | 0.0021 | 0.82 | 0.0018 | Nb: 0.014, Ta: 0.032 | 843 | 0.0053 | 2.70 | Invention steel |
| 1-7 | 0.15 | 0.15 | 0.18 | 0.03 | 0.0011 | 0.026 | 0.0046 | 0.0014 | 1.27 | 0.0028 | Nb: 0.032 | 857 | 0.0034 | 3.82 | Invention steel |
| 1-8 | 0.14 | 0.55 | 0.48 | 0.01 | 0.0025 | 0.018 | 0.0034 | 0.0018 | 0.46 | 0.0022 | Nb: 0.042, Ti: 0.013, W: 0.052 | 863 | 0.0049 | 2.43 | Invention steel |
| 1-9 | 0.15 | 0.07 | 0.65 | 0.01 | 0.0032 | 0.036 | 0.0025 | 0.0021 | 0.43 | 0.0014 | Ni: 0.028 | 835 | 0.0065 | 3.25 | Invention steel |
| 1-10 | 0.14 | 0.16 | 0.21 | 0.01 | 0.0006 | 0.038 | 0.0028 | 0.0028 | 0.77 | 0.0009 | Cu: 0.04, Mo: 0.011 | 856 | 0.0047 | 2.21 | Invention steel |
| 1-11 | 0.17 | 0.25 | 0.48 | 0.02 | 0.0022 | 0.045 | 0.0031 | 0.0016 | 0.33 | 0.0015 | Nb: 0.023, Cu: 0.025 | 848 | 0.0053 | 2.47 | Invention steel |
| 1-12 | 0.2 | 0.18 | 0.65 | 0.02 | 0.0029 | 0.023 | 0.0036 | 0.0025 | 0.38 | 0.0013 | Nb: 0.051, Ti: 0.007, Ni: 0.015, Mo: 0.035 | 832 | 0.0062 | 3.84 | Invention steel |
| 1-13 | 0.14 | 0.14 | 0.22 | 0.01 | 0.0022 | 0.029 | 0.0033 | 0.0024 | 0.45 | 0.0025 | Mg: 0.0015 | 856 | 0.0056 | 1.23 | Invention steel |

TABLE 3

| Steel | Components (% by mass) | | | | | | | | | | | Ae3 | A | K' | |
|---|---|---|---|---|---|---|---|---|---|---|---|---|---|---|---|
| No. | C | Si | Mn | P | S | Al | N | O | Cr | B | Others | (° C.) | value | value | Note |
| 1-14 | 0.15 | 0.35 | 0.86 | 0.03 | 0.0018 | 0.031 | 0.0041 | 0.0025 | 0.25 | 0.0029 | Ca: 0.0023 | 857 | 0.0053 | 3.62 | Invention steel |
| 1-15 | 0.17 | 0.22 | 0.48 | 0.01 | 0.0007 | 0.022 | 0.0028 | 0.0019 | 0.66 | 0.0044 | Nb: 0.031, Ca: 0.0028, La: 0.005 | 840 | 0.0033 | 3.52 | Invention steel |
| 1-16 | 0.18 | 0.19 | 0.25 | 0.02 | 0.0043 | 0.035 | 0.0031 | 0.0014 | 0.55 | 0.0021 | Nb: 0.018, Ti: 0.021, Y: 0.0088 | 851 | 0.0069 | 2.29 | Invention steel |
| 1-17 | 0.16 | 0.2 | 0.29 | 0.02 | 0.0025 | 0.026 | 0.0026 | 0.0027 | 0.83 | 0.0017 | Ni: 0.089, Zr: 0.0092 | 842 | 0.0061 | 3.06 | Invention steel |
| 1-18 | 0.13 | 0.17 | 0.65 | 0.01 | 0.0018 | 0.017 | 0.0045 | 0.0022 | 0.38 | 0.0028 | Cu: 0.034, Mo: 0.021, Ce: 0.008 | 849 | 0.0046 | 2.79 | Invention steel |
| 1-19 | 0.15 | 0.05 | 0.56 | 0.02 | 0.0027 | 0.053 | 0.0036 | 0.0018 | 0.45 | 0.0014 | Nb: 0.031, Ti: 0.009, Ni: 0.015, Ca: 0.0027, La: 0.003, Ce: 0.0062 | 847 | 0.0062 | 2.91 | Invention steel |

TABLE 4

| Steel | Components (% by mass) | | | | | | | | | | | Ae3 | A | K' | |
|---|---|---|---|---|---|---|---|---|---|---|---|---|---|---|---|
| No. | C | Si | Mn | P | S | Al | N | O | Cr | B | Others | (° C.) | value | value | Note |
| 1-20 | 0.2 | 0.23 | 0.68 | 0.01 | 0.0019 | 0.017 | 0.0031 | 0.0025 | 0.31 | 0.0013 | Ni: 0.045, Mo: 0.022, Ca: 0.0021, La: 0.004, Ce: 0.0085 | 820 | 0.0050 | 3.75 | Invention steel |
| 1-21 | 0.18 | 0.14 | 0.75 | 0.02 | 0.0022 | 0.063 | 0.0029 | 0.0023 | 0.23 | 0.0029 | Nb: 0.038, Ti: 0.017, V: 0.011, Mg: 0.0028, | 840 | 0.0066 | 3.51 | Invention steel |

TABLE 4-continued

| Steel No. | Components (% by mass) C | Si | Mn | P | S | Al | N | O | Cr | B | Others | Ae3 (° C.) | A value | K' value | Note |
|---|---|---|---|---|---|---|---|---|---|---|---|---|---|---|---|
| | | | | | | | | | | | Y: 0.018, Zr: 0.004, La: 0.0035, Ce: 0.0073 | | | | |
| 1-22 | 0.16 | 0.06 | 0.88 | 0.02 | 0.0087 | 0.025 | 0.0023 | 0.0023 | 0.45 | 0.0014 | Y: 0.02, Ce: 0.012 | 837 | 0.0118 | 4.50 | Comparative steel |
| 1-23 | 0.19 | 0.19 | 0.85 | 0.03 | 0.0092 | 0.031 | 0.0044 | 0.0046 | 0.38 | 0.0018 | Ni: 0.022 | 831 | 0.0148 | 4.59 | Comparative steel |
| 1-24 | 0.17 | 0.25 | 0.87 | 0.02 | 0.0023 | 0.12 | 0.0038 | 0.0038 | 0.49 | 0.0022 | Nb: 0.028 | 836 | 0.0101 | 4.73 | Comparative steel |

TABLE 5

| Steel No. | Components (% by mass) C | Si | Mn | P | S | Al | N | 0 | Cr | B | Others | Ae3 (° C.) | A value | K' value | Note |
|---|---|---|---|---|---|---|---|---|---|---|---|---|---|---|---|
| 1-25 | 0.14 | 0.22 | 0.79 | 0.02 | 0.0041 | 0.039 | 0.0058 | 0.0028 | 0.38 | 0.0027 | Mo: 0.035, Ca: 0.0018, Y: 0.026 | 848 | 0.0082 | 3.57 | Comparative steel |
| 1-26 | 0.16 | 0.04 | 0.84 | 0.02 | 0.0025 | 0.029 | 0.0029 | 0.0048 | 0.45 | 0.0011 | Nb: 0.032, Ti: 0.016, Ni: 0.031, La: 0.0028, Ce: 0.0091 | 834 | 0.0083 | 4.32 | Comparative steel |
| 1-27 | 0.17 | 0.18 | 2.51 | 0.02 | 0.0033 | 0.034 | 0.0031 | 0.0019 | 0.15 | 0.0006 | Cu: 0.026, Mo: 0.139 | 785 | 0.0063 | 11.03 | Comparative steel |
| 1-28 | 0.25 | 0.15 | 0.65 | 0.03 | 0.0029 | 0.038 | 0.0042 | 0.0022 | 0.54 | 0.0012 | Nb: 0.029, Ni: 0.017, Cu: 0.022 | 815 | 0.0064 | 5.10 | Comparative steel |

TABLE 6

| Test specimen No. | Ae3 (° C.) | Hot rolling conditions: Heating temperature (° C.) | End temperature of first rough rolling (° C.) | Rolling reduction rate of first rough rolling (%) | Time from first rolling to second rolling (seconds) | End temperature of second rough rolling (° C.) | Rolling reduction rate of second rough rolling (%) | Finishing rolling temperature (° C.) |
|---|---|---|---|---|---|---|---|---|
| 1-1A | 850 | 1220 | 1135 | 74 | 50.4 | 1027 | 27 | 855 |
| 1-1B | 850 | 1200 | 1156 | 55 | 38.2 | 1116 | 25 | 870 |
| 1-2A | 839 | 1200 | 1136 | 69 | 60.4 | 1030 | 25 | 865 |
| 1-2B | 839 | 1120 | 1085 | 62 | 40 | 1051 | 21 | 850 |
| 1-3A | 846 | 1180 | 1076 | 63 | 35.6 | 1031 | 22 | 875 |
| 1-3B | 846 | 1160 | 1050 | 58 | 38.7 | 1002 | 22 | 880 |
| 1-4A | 841 | 1160 | 1097 | 61 | 41.9 | 1036 | 23 | 876 |
| 1-4B | 841 | 1160 | 1010 | 57 | 32.9 | 982 | 23 | 846 |
| 1-5A | 853 | 1220 | 1130 | 55 | 36.4 | 1080 | 26 | 910 |
| 1-5B | 853 | 1150 | 1055 | 62 | 38.1 | 1038 | 18 | 880 |
| 1-6A | 843 | 1200 | 1098 | 58 | 35.4 | 1043 | 19 | 875 |
| 1-6B | 843 | 1200 | 1131 | 55 | 63.6 | 1039 | 8 | 891 |
| 1-7A | 857 | 1180 | 1122 | 60 | 57.7 | 1040 | 26 | 875 |
| 1-7B | 857 | 1180 | 1148 | 66 | 23.7 | 1117 | 22 | 962 |
| 1-8A | 863 | 1230 | 1118 | 58 | 38.1 | 1090 | 22 | 878 |
| 1-8B | 863 | 1150 | 1096 | 63 | 34.9 | 1047 | 28 | 798 |
| 1-9A | 835 | 1180 | 1109 | 56 | 40.4 | 1061 | 27 | 873 |
| 1-9B | 835 | 1150 | 1051 | 66 | 41.6 | 1034 | 18 | 865 |

| Test specimen No. | Time of air cooling after finishing rolling (seconds) | Cooling rate until coiling (° C./sec) | Coiling temperature (° C.) | Note |
|---|---|---|---|---|
| 1-1A | 1.5 | 18 | 530 | Invention example |
| 1-1B | 1 | 18 | 510 | Invention example |
| 1-2A | 2 | 25 | 480 | Invention example |
| 1-2B | 2 | 38 | 550 | Comparative example |

TABLE 6-continued

| | | | | |
|---|---|---|---|---|
| 1-3A | 5 | 38 | 580 | Invention example |
| 1-3B | 5 | 45 | 500 | Comparative example |
| 1-4A | 7 | 45 | 450 | Invention example |
| 1-4B | 6 | 30 | 460 | Comparative example |
| 1-5A | 9 | 45 | 475 | Invention example |
| 1-5B | 8 | 30 | 550 | Invention example |
| 1-6A | 2 | 25 | 430 | Invention example |
| 1-6B | 5 | 30 | 480 | Comparative example |
| 1-7A | 3 | 30 | 450 | Invention example |
| 1-7B | 5 | 30 | 480 | Comparative example |
| 1-8A | 5 | 20 | 480 | Invention example |
| 1-8B | 8 | 35 | 500 | Comparative example |
| 1-9A | 2 | 15 | 550 | Invention example |
| 1-9B | 0.5 | 10 | 500 | Comparative example |

TABLE 7

| | | Hot rolling conditions | | | | | | |
|---|---|---|---|---|---|---|---|---|
| Test specimen No. | Ae3 (° C.) | Heating temperature (° C.) | End temperature of first rough rolling (° C.) | Rolling reduction rate of first rough rolling (%) | Time from first rolling to second rolling (seconds) | End temperature of second rough rolling (° C.) | Rolling reduction rate of second rough rolling (%) | Finishing rolling temperature (° C.) |
| 1-10A | 856 | 1150 | 1093 | 60 | 37.5 | 1061 | 26 | 870 |
| 1-10B | 856 | 1150 | 1002 | 59 | 48.2 | 978 | 27 | 868 |
| 1-11A | 848 | 1180 | 1066 | 59 | 37.4 | 1030 | 21 | 880 |
| 1-11B | 848 | 1220 | 1137 | 63 | 41 | 1089 | 20 | 865 |
| 1-11C | 848 | 1220 | 1092 | 68 | 39.6 | 1026 | 16 | 876 |
| 1-12A | 832 | 1230 | 1193 | 64 | 57.5 | 1114 | 18 | 915 |
| 1-12B | 832 | 1200 | 1079 | 67 | 34.1 | 1053 | 16 | 875 |
| 1-12C | 832 | 1180 | 1135 | 57 | 58.4 | 1064 | 20 | 855 |
| 1-13A | 856 | 1220 | 1144 | 55 | 46.3 | 1070 | 21 | 890 |
| 1-13B | 856 | 1180 | 1139 | 57 | 62.4 | 1066 | 26 | 875 |
| 1-14A | 857 | 1180 | 1064 | 58 | 37.6 | 1033 | 24 | 873 |
| 1-14B | 857 | 1180 | 1149 | 39 | 44.3 | 1040 | 22 | 891 |
| 1-15 | 840 | 1220 | 1165 | 61 | 66.9 | 1074 | 19 | 905 |
| 1-16 | 851 | 1200 | 1107 | 57 | 47.3 | 1039 | 18 | 875 |
| 1-17A | 842 | 1200 | 1147 | 59 | 50.6 | 1074 | 25 | 870 |
| 1-17B | 842 | 1150 | 1049 | 60 | 41.4 | 1022 | 26 | 855 |
| 1-17C | 842 | 1200 | 1125 | 64 | 51.9 | 1042 | 18 | 805 |
| 1-18A | 849 | 1180 | 1060 | 64 | 37.3 | 1031 | 23 | 870 |
| 1-18B | 849 | 1150 | 1073 | 58 | 37.5 | 1038 | 19 | 865 |

| Test specimen No. | Time of air cooling after finishing rolling (seconds) | Cooling rate until coiling (° C./sec) | Coiling temperature (° C.) | Note |
|---|---|---|---|---|
| 1-10A | 5 | 25 | 480 | Invention example |
| 1-10B | 6 | 15 | 470 | Comparative example |
| 1-11A | 5 | 40 | 450 | Invention example |
| 1-11B | 4 | 5 | 520 | Comparative example |
| 1-11C | 5 | 40 | 630 | Comparative example |
| 1-12A | 8 | 55 | 550 | Invention example |
| 1-12B | 5 | 40 | 530 | Invention example |
| 1-12C | 2.5 | 15 | 650 | Comparative example |
| 1-13A | 3.5 | 30 | 450 | Invention example |
| 1-13B | 6 | 15 | 480 | Invention example |
| 1-14A | 6 | 20 | 550 | Invention example |
| 1-14B | 6 | 30 | 520 | Comparative example |
| 1-15 | 9 | 55 | 530 | Invention example |
| 1-16 | 2 | 15 | 530 | Invention example |
| 1-17A | 3.5 | 30 | 520 | Invention example |
| 1-17B | 4 | 25 | 500 | Invention example |
| 1-17C | 6 | 10 | 610 | Comparative example |
| 1-18A | 7 | 35 | 480 | Invention example |
| 1-18B | 6 | 45 | 480 | Invention example |

TABLE 8

| Test specimen No. | Ae3 (° C.) | Hot rolling conditions: Heating temperature (° C.) | End temperature of first rough rolling (° C.) | Rolling reduction rate of first rough rolling (%) | Time from first rolling to second rolling (seconds) | End temperature of second rough rolling (° C.) | Rolling reduction rate of second rough rolling (%) | Finishing rolling temperature (° C.) |
|---|---|---|---|---|---|---|---|---|
| 1-19A | 847 | 1220 | 1162 | 62 | 43.8 | 1119 | 27 | 870 |
| 1-19B | 847 | 1200 | 1127 | 66 | 63.5 | 1037 | 27 | 880 |
| 1-20 | 820 | 1180 | 1075 | 64 | 35.9 | 1054 | 23 | 900 |
| 1-21A | 840 | 1230 | 1149 | 59 | 41.5 | 1124 | 25 | 915 |
| 1-21B | 840 | 1180 | 1131 | 61 | 35.3 | 1082 | 24 | 868 |
| 1-21C | 840 | 1170 | 1091 | 60 | 45.4 | 1026 | 19 | 870 |
| 1-22A | 837 | 1180 | 1137 | 62 | 37.5 | 1096 | 24 | 877 |
| 1-22B | 837 | 1180 | 1097 | 57 | 39.7 | 1046 | 28 | 855 |
| 1-23 | 831 | 1180 | 1131 | 60 | 36.2 | 1077 | 18 | 860 |
| 1-24 | 836 | 1180 | 1078 | 58 | 37.2 | 1048 | 18 | 880 |
| 1-25 | 848 | 1160 | 1108 | 58 | 57.4 | 1037 | 24 | 875 |
| 1-26 | 834 | 1160 | 1078 | 66 | 41.2 | 1036 | 18 | 860 |
| 1-27 | 785 | 1150 | 1084 | 61 | 37.4 | 1049 | 29 | 840 |
| 1-28 | 815 | 1150 | 1071 | 58 | 35.8 | 1044 | 25 | 865 |

| Test specimen No. | Time of air cooling after finishing rolling (seconds) | Cooling rate until coiling (° C./sec) | Coiling temperature (° C.) | Note |
|---|---|---|---|---|
| 1-19A | 8 | 40 | 550 | Invention example |
| 1-19B | 9 | 55 | 580 | Invention example |
| 1-20 | 2 | 10 | 520 | Invention example |
| 1-21A | 7 | 30 | 500 | Invention example |
| 1-21B | 5 | 15 | 530 | Invention example |
| 1-21C | 0.5 | 15 | 550 | Comparative example |
| 1-22A | 2 | 15 | 530 | Comparative example |
| 1-22B | 1 | 15 | 550 | Comparative example |
| 1-23 | 2 | 20 | 550 | Comparative example |
| 1-24 | 4 | 25 | 530 | Comparative example |
| 1-25 | 2 | 25 | 550 | Comparative example |
| 1-26 | 2 | 25 | 530 | Comparative example |
| 1-27 | 2 | 10 | 550 | Comparative example |
| 1-28 | 2.5 | 20 | 580 | Comparative example |

TABLE 9

| Test specimen No. | A value | K' value | Characteristics of hot-rolled steel plate: Area fraction of pearlite bands having lengths of 1 mm or longer (%) | Ultimate deformability ratio (φc/φL) | Note |
|---|---|---|---|---|---|
| 1-1A | 0.0039 | 2.16 | 2 | 0.91 | Invention example |
| 1-1B | 0.0039 | 2.16 | 1.9 | 0.93 | Invention example |
| 1-2A | 0.0041 | 3.15 | 1.4 | 0.96 | Invention example |
| 1-2B | 0.0041 | 3.15 | 5.2 | 0.75 | Comparative example |
| 1-3A | 0.0053 | 3.15 | 3 | 0.91 | Invention example |
| 1-3B | 0.0053 | 3.15 | 5.9 | 0.74 | Comparative example |
| 1-4A | 0.0035 | 2.72 | 2 | 0.92 | Invention example |
| 1-4B | 0.0035 | 2.72 | 3.2 | 0.75 | Comparative example |
| 1-5A | 0.005 | 2.82 | 1.55 | 0.94 | Invention example |
| 1-5B | 0.005 | 2.82 | 1.2 | 0.96 | Invention example |
| 1-6A | 0.0053 | 2.70 | 2.6 | 0.93 | Invention example |
| 1-6B | 0.0053 | 2.70 | 2.9 | 0.78 | Comparative example |
| 1-7A | 0.0034 | 3.82 | 1.9 | 0.98 | Invention example |
| 1-7B | 0.0034 | 3.82 | 4.1 | 0.77 | Comparative example |
| 1-8A | 0.0049 | 2.43 | 1.3 | 0.93 | Invention example |
| 1-8B | 0.0049 | 2.43 | 3.8 | 0.77 | Comparative example |
| 1-9A | 0.0065 | 3.25 | 1.2 | 0.96 | Invention example |
| 1-9B | 0.0065 | 3.25 | 4.3 | 0.77 | Comparative example |
| 1-10A | 0.0047 | 2.21 | 1.4 | 0.96 | Invention example |
| 1-10B | 0.0047 | 2.21 | 2.8 | 0.72 | Comparative example |
| 1-11A | 0.0053 | 2.47 | 1.8 | 0.94 | Invention example |

TABLE 9-continued

| Test specimen No. | A value | K' value | Characteristics of hot-rolled steel plate: Area fraction of pearlite bands having lengths of 1 mm or longer (%) | Characteristics of hot-rolled steel plate: Ultimate deformability ratio (ϕc/ϕL) | Note |
|---|---|---|---|---|---|
| 1-11B | 0.0053 | 2.47 | 3.8 | 0.76 | Comparative example |
| 1-11C | 0.0053 | 2.47 | 4.8 | 0.73 | Comparative example |
| 1-12A | 0.0062 | 3.84 | 2.3 | 0.94 | Invention example |
| 1-12B | 0.0062 | 3.84 | 2.5 | 0.92 | Invention example |
| 1-12C | 0.0062 | 3.84 | 4.5 | 0.72 | Comparative example |

TABLE 10

| Test specimen No. | A value | K' value | Characteristics of hot-rolled steel plate: Area fraction of pearlite bands having lengths of 1 mm or longer (%) | Characteristics of hot-rolled steel plate: Ultimate deformability ratio (ϕc/ϕL) | Note |
|---|---|---|---|---|---|
| 1-13A | 0.0056 | 1.23 | 0.8 | 0.93 | Invention example |
| 1-13B | 0.0056 | 1.23 | 0.9 | 0.94 | Invention example |
| 1-14A | 0.0053 | 3.62 | 2.4 | 0.92 | Invention example |
| 1-14B | 0.0053 | 3.62 | 4.3 | 0.71 | Comparative example |
| 1-15 | 0.0033 | 3.52 | 2.1 | 0.93 | Invention example |
| 1-16 | 0.0069 | 2.29 | 1.5 | 0.91 | Invention example |
| 1-17A | 0.0061 | 3.06 | 2.1 | 0.93 | Invention example |
| 1-17B | 0.0061 | 3.06 | 2.1 | 0.94 | Invention example |
| 1-17C | 0.0061 | 3.06 | 3.9 | 0.8 | Comparative example |
| 1-18A | 0.0046 | 2.79 | 1.1 | 0.96 | Invention example |
| 1-18B | 0.0046 | 2.79 | 1.2 | 0.94 | Invention example |
| 1-19A | 0.0062 | 2.91 | 1.5 | 0.91 | Invention example |
| 1-19B | 0.0062 | 2.91 | 1.4 | 0.93 | Invention example |
| 1-20 | 0.005 | 3.75 | 2.4 | 0.92 | Invention example |
| 1-21A | 0.0066 | 3.51 | 2.7 | 0.94 | Invention example |
| 1-21B | 0.0066 | 3.51 | 2.9 | 0.91 | Invention example |
| 1-21C | 0.0066 | 3.51 | 4.8 | 0.76 | Comparative example |
| 1-22A | 0.0118 | 4.50 | 3.3 | 0.7 | Comparative example |
| 1-22B | 0.0118 | 4.50 | 3.8 | 0.65 | Comparative example |
| 1-23 | 0.0148 | 4.59 | 3.8 | 0.67 | Comparative example |
| 1-24 | 0.0101 | 4.73 | 3.5 | 0.73 | Comparative example |
| 1-25 | 0.0082 | 3.57 | 2.2 | 0.75 | Comparative example |
| 1-26 | 0.0083 | 4.32 | 3.1 | 0.72 | Comparative example |
| 1-27 | 0.0063 | 11.03 | 12.1 | 0.68 | Comparative example |
| 1-28 | 0.0064 | 5.10 | 6.3 | 0.8 | Comparative example |

Example 3

50 kg of a steel ingot having each of the component compositions as shown in Tables 11 and 12 was melted in the laboratory through vacuum melting, and a steel plate having a thickness of 10 mm was produced under each of the conditions as shown in Tables 13 to 15. Meanwhile, the chemical compositions of the test specimens in tables 13 to 15 are the same as the chemical compositions of steel ingots having the same steel numbers as the test specimen numbers.

The area fractions of the pearlite bands and ultimate deformability ratios were measured by the same methods as in Example 2. The obtained results are shown in Tables 16 and 17.

TABLE 11

| Steel No. | Components (% by mass): C | Si | Mn | P | S | Al | N | 0 | Others | Ae3 (° C.) | A value | K value | Note |
|---|---|---|---|---|---|---|---|---|---|---|---|---|---|
| 2-1 | 0.14 | 0.02 | 1.25 | 0.005 | 0.0014 | 0.033 | 0.0024 | 0.0027 | | 824 | 0.0052 | 3.20 | Invention steel |
| 2-2 | 0.15 | 0.13 | 1.34 | 0.009 | 0.0008 | 0.023 | 0.0025 | 0.0029 | | 824 | 0.0045 | 3.86 | Invention steel |
| 2-3 | 0.16 | 0.15 | 1.28 | 0.02 | 0.0015 | 0.042 | 0.0031 | 0.0026 | Nb: 0.015 | 831 | 0.0055 | 3.84 | Invention steel |
| 2-4 | 0.13 | 0.04 | 1.85 | 0.018 | 0.0008 | 0.026 | 0.0029 | 0.0027 | Ti: 0.037 | 820 | 0.0044 | 5.64 | Invention steel |

TABLE 11-continued

| Steel | Components (% by mass) | | | | | | | | | Ae3 | A | K | |
|---|---|---|---|---|---|---|---|---|---|---|---|---|---|
| No. | C | Si | Mn | P | S | Al | N | 0 | Others | (° C.) | value | value | Note |
| 2-5 | 0.17 | 0.35 | 1.28 | 0.024 | 0.0023 | 0.031 | 0.0024 | 0.0024 | V: 0.006 | 837 | 0.0057 | 4.10 | Invention steel |
| 2-6 | 0.19 | 0.23 | 1.36 | 0.015 | 0.0016 | 0.028 | 0.0022 | 0.0019 | Nb: 0.028, Ta: 0.02 | 816 | 0.0044 | 4.97 | Invention steel |
| 2-7 | 0.15 | 0.21 | 1.45 | 0.017 | 0.0009 | 0.019 | 0.0034 | 0.0028 | Nb: 0.038 | 829 | 0.0043 | 4.35 | Invention steel |
| 2-8 | 0.15 | 0.15 | 1.35 | 0.018 | 0.0020 | 0.037 | 0.0024 | 0.0028 | Nb: 0.056, Ti: 0.013, W: 0.035 | 831 | 0.0060 | 3.90 | Invention steel |
| 2-9 | 0.16 | 0.02 | 1.12 | 0.016 | 0.0021 | 0.032 | 0.0022 | 0.0029 | Mo: 0.033 | 829 | 0.0061 | 3.12 | Invention steel |
| 2-10 | 0.16 | 0.06 | 1.68 | 0.015 | 0.0006 | 0.023 | 0.0026 | 0.0025 | | 812 | 0.0039 | 5.64 | Invention steel |
| 2-11 | 0.14 | 0.22 | 1.48 | 0.016 | 0.0023 | 0.034 | 0.0028 | 0.0021 | B: 0.002, Nb: 0.028, Cu: 0.025 | 831 | 0.0055 | 4.23 | Invention steel |
| 2-12 | 0.13 | 0.14 | 1.89 | 0.025 | 0.0026 | 0.055 | 0.0033 | 0.0022 | Nb: 0.025, Ti: 0.007, Ni: 0.017 | 826 | 0.0066 | 5.82 | Invention steel |
| 2-13 | 0.16 | 0.04 | 2.25 | 0.022 | 0.0022 | 0.043 | 0.0026 | 0.0026 | Cu: 0.035, Mg: 0.0015 | 800 | 0.0062 | 8.21 | Invention steel |
| 2-14 | 0.14 | 0.63 | 1.44 | 0.017 | 0.0018 | 0.027 | 0.0021 | 0.0018 | Ca: 0.0021 | 846 | 0.0045 | 4.05 | Invention steel |
| 2-15 | 0.16 | 0.21 | 1.51 | 0.022 | 0.0007 | 0.027 | 0.0023 | 0.0015 | Nb: 0.036, W: 0.013, Y: 0.007 | 827 | 0.0031 | 4.88 | Invention steel |
| 2-16 | 0.19 | 0.15 | 2.42 | 0.024 | 0.0022 | 0.031 | 0.0021 | 0.0019 | Nb: 0.028, Ti: 0.013, Zr: 0.008 | 788 | 0.0051 | 9.74 | Invention steel |
| 2-17 | 0.18 | 0.18 | 1.07 | 0.028 | 0.0045 | 0.012 | 0.0019 | 0.0016 | La: 0.006 | 837 | 0.0065 | 3.41 | Invention steel |

TABLE 12

| Steel | Components (% by mass) | | | | | | | | | Ae3 | A | K | |
|---|---|---|---|---|---|---|---|---|---|---|---|---|---|
| No. | C | Si | Mn | P | S | Al | N | 0 | Others | (° C.) | value | value | Note |
| 2-18 | 0.15 | 0.05 | 1.87 | 0.022 | 0.0038 | 0.027 | 0.0023 | 0.0021 | Ni: 0.05, Mo: 0.021, Ce: 0.008 | 811 | 0.0068 | 6.24 | Invention steel |
| 2-19 | 0.14 | 0.08 | 1.15 | 0.021 | 0.0033 | 0.018 | 0.0038 | 0.0022 | Nb: 0.033, Ti: 0.018, Ca: 0.0024, La: 0.0028, Ce: 0.0063 | 841 | 0.0061 | 2.75 | Invention steel |
| 2-20 | 0.19 | 0.05 | 1.56 | 0.022 | 0.0045 | 0.023 | 0.0032 | 0.0015 | B: 0.002, Ni: 0.02, Mo: 0.022, Ca: 0.0022, La: 0.0051, Ce: 0.012 | 808 | 0.0068 | 5.87 | Invention steel |
| 2-21 | 0.2 | 0.11 | 1.46 | 0.024 | 0.0026 | 0.038 | 0.0026 | 0.0015 | Nb: 0.031, Ti: 0.008, Mg: 0.0022, Y: 0.015, Zr: 0.003, La: 0.0035, Ce: 0.0082 | 813 | 0.0054 | 5.67 | Invention steel |
| 2-22 | 0.15 | 0.18 | 1.29 | 0.028 | 0.0084 | 0.012 | 0.0047 | 0.0029 | Y: 0.02, Ce: 0.012 | 842 | 0.0117 | 3.63 | Comparative example |
| 2-23 | 0.18 | 0.21 | 1.64 | 0.022 | 0.0090 | 0.037 | 0.0023 | 0.0044 | Ni: 0.015 | 815 | 0.0146 | 5.97 | Comparative example |
| 2-24 | 0.15 | 0.08 | 1.39 | 0.021 | 0.0033 | 0.125 | 0.0045 | 0.0042 | Nb: 0.033 | 830 | 0.0116 | 4.08 | Comparative example |
| 2-25 | 0.16 | 0.05 | 1.64 | 0.022 | 0.0034 | 0.043 | 0.0032 | 0.0029 | B: 0.002, Mo: 0.035, Ca: 0.0027, Y: 0.013 | 819 | 0.0077 | 5.46 | Invention steel |
| 2-26 | 0.15 | 0.11 | 1.38 | 0.024 | 0.0036 | 0.015 | 0.0025 | 0.0045 | Nb: 0.031, Ti: 0.008, Ni: 0.02, Ce: 0.015 | 832 | 0.0086 | 4.04 | Comparative example |

TABLE 12-continued

| Steel | Components (% by mass) | | | | | | | | | Ae3 | A | K | |
|---|---|---|---|---|---|---|---|---|---|---|---|---|---|
| No. | C | Si | Mn | P | S | Al | N | 0 | Others | (° C.) | value | value | Note |
| 2-27 | 0.18 | 0.24 | 2.87 | 0.026 | 0.0039 | 0.047 | 0.0024 | 0.0024 | Cu: 0.024, Mo: 0.125 | 782 | 0.0079 | 11.51 | Comparative example |
| 2-28 | 0.24 | 0.10 | 1.89 | 0.025 | 0.0045 | 0.033 | 0.0029 | 0.0025 | Nb: 0.038, Ni: 0.014, Cu: 0.02 | 784 | 0.0081 | 8.63 | Comparative example |

TABLE 13

| | | Hot rolling conditions | | | | | | |
|---|---|---|---|---|---|---|---|---|
| Test specimen No. | Ae3 (° C.) | Heating temperature (° C.) | End temperature of first rough rolling (° C.) | Rolling reduction rate of first rough rolling (%) | Time from first rolling to second rolling (seconds) | End temperature of second rough rolling (° C.) | Rolling reduction rate of second rough rolling (%) | Finishing rolling temperature (° C.) |
| 2-1A | 824 | 1200 | 1075 | 77 | 44.8 | 1049 | 20 | 860 |
| 2-1B | 824 | 1180 | 1062 | 52 | 32.3 | 1025 | 22 | 875 |
| 2-1C | 824 | 1160 | 1000 | 66 | 44.7 | 962 | 16 | 836 |
| 2-2A | 824 | 1220 | 1099 | 78 | 37.4 | 1057 | 18 | 870 |
| 2-2B | 824 | 1100 | 1072 | 60 | 31.2 | 1026 | 24 | 830 |
| 2-3A | 831 | 1200 | 1121 | 66 | 44.1 | 1058 | 18 | 860 |
| 2-3B | 831 | 1150 | 1041 | 58 | 33.3 | 995 | 19 | 841 |
| 2-4 | 820 | 1150 | 1091 | 72 | 41.8 | 1031 | 24 | 861 |
| 2-5A | 837 | 1230 | 1133 | 55 | 36.7 | 1094 | 25 | 905 |
| 2-5B | 837 | 1160 | 1073 | 57 | 37.7 | 1035 | 24 | 850 |
| 2-6A | 816 | 1200 | 1079 | 57 | 32.1 | 1054 | 28 | 869 |
| 2-6B | 816 | 1200 | 1061 | 59 | 26.6 | 1042 | 16 | 832 |
| 2-7 | 829 | 1200 | 1095 | 59 | 31.6 | 1070 | 19 | 880 |
| 8A | 831 | 1250 | 1150 | 63 | 42.5 | 1111 | 19 | 873 |
| 2-8B | 831 | 1160 | 1030 | 53 | 36.9 | 1002 | 16 | 806 |
| 2-9A | 829 | 1180 | 1075 | 63 | 27.4 | 1052 | 18 | 868 |
| 2-9B | 829 | 1160 | 1039 | 66 | 32 | 1012 | 27 | 835 |
| 2-9C | 829 | 1150 | 1052 | 41 | 33.2 | 1028 | 23 | 838 |

| Test specimen No. | Time of air cooling after finishing rolling (seconds) | Cooling rate until coiling (° C./sec) | Coiling temperature (° C.) | Note |
|---|---|---|---|---|
| 2-1A | 2 | 15 | 550 | Invention example |
| 2-1B | 1.5 | 15 | 540 | Invention example |
| 2-1C | 5 | 25 | 520 | Comparative example |
| 2-2A | 3 | 20 | 500 | Invention example |
| 2-2B | 1 | 40 | 580 | Comparative example |
| 2-3A | 3 | 35 | 550 | Invention example |
| 2-3B | 3 | 40 | 530 | Comparative example |
| 2-4 | 6 | 40 | 500 | Invention example |
| 2-5A | 8 | 50 | 490 | Invention example |
| 2-5B | 9 | 30 | 580 | Invention example |
| 2-6A | 3 | 20 | 450 | Invention example |
| 2-6B | 6 | 25 | 490 | Comparative example |
| 2-7 | 2 | 25 | 480 | Invention example |
| 8A | 6 | 15 | 550 | Invention example |
| 2-8B | 9 | 45 | 570 | Comparative example |
| 2-9A | 3 | 20 | 580 | Invention example |
| 2-9B | 0.5 | 10 | 530 | Comparative example |
| 2-9C | 3 | 15 | 500 | Comparative example |

TABLE 14

| Test specimen No. | Ae3 (° C.) | Hot rolling conditions: Heating temperature (° C.) | End temperature of first rough rolling (° C.) | Rolling reduction rate of first rough rolling (%) | Time from first rolling to second rolling (seconds) | End temperature of second rough rolling (° C.) | Rolling reduction rate of second rough rolling (%) | Finishing rolling temperature (° C.) |
|---|---|---|---|---|---|---|---|---|
| 2-10A | 812 | 1160 | 1063 | 80 | 40.7 | 1032 | 24 | 850 |
| 2-10B | 812 | 1160 | 1082 | 53 | 34.3 | 1036 | 11 | 822 |
| 2-11A | 831 | 1200 | 1096 | 64 | 43 | 1072 | 22 | 885 |
| 2-11B | 831 | 1200 | 1082 | 60 | 42.9 | 1045 | 16 | 870 |
| 2-11C | 831 | 1200 | 1131 | 55 | 33.4 | 1090 | 27 | 880 |
| 2-12A | 826 | 1250 | 1125 | 68 | 39.6 | 1103 | 26 | 925 |
| 2-12B | 826 | 1200 | 1123 | 58 | 42.4 | 1086 | 18 | 890 |
| 2-12C | 826 | 1180 | 1087 | 66 | 41.9 | 1027 | 17 | 840 |
| 2-13A | 800 | 1200 | 1125 | 76 | 58.1 | 1060 | 34 | 888 |
| 2-13B | 800 | 1200 | 1068 | 78 | 59 | 1026 | 16 | 867 |
| 2-13C | 800 | 1200 | 1080 | 73 | 54.6 | 992 | 22 | 854 |
| 2-14 | 846 | 1200 | 1069 | 72 | 44.3 | 1042 | 24 | 848 |
| 2-15 | 827 | 1230 | 1111 | 64 | 34.3 | 1065 | 28 | 910 |
| 2-16 | 788 | 1180 | 1055 | 68 | 34.4 | 1027 | 27 | 864 |
| 2-17A | 837 | 1180 | 1091 | 66 | 43 | 1059 | 28 | 856 |
| 2-17B | 837 | 1180 | 1050 | 68 | 41.2 | 1026 | 21 | 845 |
| 2-17C | 837 | 1220 | 1090 | 60 | 47.8 | 1028 | 19 | 810 |

| Test specimen No. | Time of air cooling after finishing rolling (seconds) | Cooling rate until coiling (° C./sec) | Coiling temperature (° C.) | Note |
|---|---|---|---|---|
| 2-10A | 6 | 30 | 500 | Invention example |
| 2-10B | 5 | 10 | 490 | Comparative example |
| 2-11A | 6 | 40 | 480 | Invention example |
| 2-11B | 5 | 8 | 520 | Comparative example |
| 2-11C | 6 | 50 | 650 | Comparative example |
| 2-12A | 9 | 60 | 500 | Invention example |
| 2-12B | 4 | 45 | 570 | Invention example |
| 2-12C | 2 | 10 | 630 | Comparative example |
| 2-13A | 3 | 35 | 420 | Invention example |
| 2-13B | 5 | 10 | 450 | Invention example |
| 2-13C | 6 | 20 | 520 | Comparative example |
| 2-14 | 5 | 15 | 560 | Invention example |
| 2-15 | 8 | 60 | 530 | Invention example |
| 2-16 | 1.5 | 20 | 550 | Invention example |
| 2-17A | 3 | 30 | 500 | Invention example |
| 2-17B | 3 | 30 | 500 | Invention example |
| 2-17C | 6 | 15 | 600 | Comparative example |

TABLE 15

| Test specimen No. | Ae3 (° C.) | Hot rolling conditions: Heating temperature (° C.) | End temperature of first rough rolling (° C.) | Rolling reduction rate of first rough rolling (%) | Time from first rolling to second rolling (seconds) | End temperature of second rough rolling (° C.) | Rolling reduction rate of second rough rolling (%) | Finishing rolling temperature (° C.) |
|---|---|---|---|---|---|---|---|---|
| 2-18A | 811 | 1180 | 1091 | 59 | 38.7 | 1046 | 21 | 880 |
| 2-18B | 811 | 1180 | 1112 | 70 | 35.6 | 1071 | 18 | 872 |
| 2-19A | 841 | 1180 | 1052 | 60 | 36.3 | 1023 | 23 | 852 |
| 2-19B | 841 | 1180 | 1077 | 78 | 56.2 | 1041 | 26 | 849 |
| 2-20 | 808 | 1170 | 1085 | 75 | 44.5 | 1042 | 20 | 889 |
| 2-21A | 813 | 1250 | 1161 | 75 | 45.2 | 1123 | 28 | 910 |
| 2-21B | 813 | 1170 | 1075 | 60 | 40.6 | 1051 | 18 | 843 |
| 2-21C | 813 | 1170 | 1085 | 59 | 36.7 | 1036 | 28 | 835 |
| 2-22A | 842 | 1200 | 1079 | 60 | 38.7 | 1025 | 26 | 870 |
| 2-22B | 842 | 1150 | 1089 | 53 | 37.8 | 1034 | 19 | 867 |
| 2-23 | 815 | 1200 | 1065 | 70 | 38.5 | 1035 | 20 | 858 |
| 2-24 | 830 | 1150 | 1053 | 53 | 33.6 | 1028 | 20 | 849 |
| 2-25 | 819 | 1150 | 1048 | 54 | 38.5 | 1021 | 18 | 828 |
| 2-26 | 832 | 1180 | 1080 | 79 | 52.7 | 1042 | 28 | 858 |
| 2-27 | 782 | 1150 | 1066 | 53 | 36.8 | 1034 | 23 | 828 |
| 2-28 | 784 | 1150 | 1060 | 65 | 46.1 | 1026 | 20 | 835 |

TABLE 15-continued

| Test specimen No. | Time of air cooling after finishing rolling (seconds) | Cooling rate until coiling (° C./sec) | Coiling temperature (° C.) | Note |
|---|---|---|---|---|
| 2-18A | 8 | 40 | 500 | Invention example |
| 2-18B | 6 | 55 | 500 | Invention example |
| 2-19A | 9 | 40 | 530 | Invention example |
| 2-19B | 10 | 65 | 550 | Invention example |
| 2-20 | 3 | 10 | 480 | Invention example |
| 2-21A | 8 | 40 | 500 | Invention example |
| 2-21B | 6 | 10 | 550 | Invention example |
| 2-21C | 0.5 | 15 | 580 | Comparative example |
| 2-22A | 3 | 15 | 550 | Comparative example |
| 2-22B | 1.5 | 15 | 580 | Comparative example |
| 2-23 | 3 | 20 | 580 | Comparative example |
| 2-24 | 6 | 20 | 550 | Comparative example |
| 2-25 | 1.5 | 20 | 570 | Invention example |
| 2-26 | 1.5 | 30 | 540 | Comparative example |
| 2-27 | 1.5 | 15 | 580 | Comparative example |
| 2-28 | 2 | 25 | 580 | Comparative example |

TABLE 16

| Test specimen No. | A value | K' value | Characteristics of hot-rolled steel plate: Area fraction of pearlite bands having lengths of 1 mm or longer (%) | Characteristics of hot-rolled steel plate: Ultimate deformability ratio (φc/φL) | Note |
|---|---|---|---|---|---|
| 2-1A | 0.0052 | 3.20 | 2.7 | 0.91 | Invention example |
| 2-1B | 0.0052 | 3.20 | 2.8 | 0.92 | Invention example |
| 2-1C | 0.0052 | 3.20 | 4.3 | 0.74 | Comparative example |
| 2-2A | 0.0045 | 3.86 | 2.1 | 0.98 | Invention example |
| 2-2B | 0.0045 | 3.86 | 5.2 | 0.78 | Comparative example |
| 2-3A | 0.0055 | 3.84 | 3.3 | 0.92 | Invention example |
| 2-3B | 0.0055 | 3.84 | 6.5 | 0.76 | Comparative example |
| 2-4 | 0.0044 | 5.64 | 4.2 | 0.91 | Invention example |
| 2-5A | 0.0057 | 4.10 | 3.1 | 0.9 | Invention example |
| 2-5B | 0.0057 | 4.10 | 1.9 | 0.96 | Invention example |
| 2-6A | 0.0044 | 4.97 | 2.5 | 0.92 | Invention example |
| 2-6B | 0.0044 | 4.97 | 5.51 | 0.79 | Comparative example |
| 2-7 | 0.0043 | 4.35 | 3.2 | 0.97 | Invention example |
| 2-8A | 0.006 | 3.90 | 2.4 | 0.91 | Invention example |
| 2-8B | 0.006 | 3.90 | 5.1 | 0.79 | Comparative example |
| 2-9A | 0.0061 | 3.12 | 2.5 | 0.96 | Invention example |
| 2-9B | 0.0061 | 3.12 | 4 | 0.77 | Comparative example |
| 2-9C | 0.0061 | 3.12 | 4.27 | 0.75 | Comparative example |
| 2-10A | 0.0039 | 5.64 | 1.5 | 0.97 | Invention example |
| 2-10B | 0.0039 | 5.64 | 7.3 | 0.71 | Comparative example |
| 2-11A | 0.0055 | 4.23 | 3.6 | 0.93 | Invention example |
| 2-11B | 0.0055 | 4.23 | 5.3 | 0.75 | Comparative example |
| 2-11C | 0.0055 | 4.23 | 6.7 | 0.72 | Comparative example |
| 2-12A | 0.0066 | 5.82 | 3.8 | 0.95 | Invention example |
| 2-12B | 0.0066 | 5.82 | 4.9 | 0.9 | Invention example |
| 2-12C | 0.0066 | 5.82 | 6.8 | 0.72 | Comparative example |

TABLE 17

| Test specimen No. | A value | K value | Characteristics of hot-rolled steel plate: Area fraction of pearlite bands having lengths of 1 mm or longer (%) | Characteristics of hot-rolled steel plate: Ultimate deformability ratio (φc/φL) | Note |
|---|---|---|---|---|---|
| 2-13A | 0.0062 | 8.21 | 4.6 | 0.9 | Invention example |
| 2-13B | 0.0062 | 8.21 | 4.3 | 0.91 | Invention example |
| 2-13C | 0.0062 | 8.21 | 11.7 | 0.77 | Comparative example |

TABLE 17-continued

| Test specimen No. | A value | K value | Characteristics of hot-rolled steel plate: Area fraction of pearlite bands having lengths of 1 mm or longer (%) | Characteristics of hot-rolled steel plate: Ultimate deformability ratio (ϕc/ϕL) | Note |
|---|---|---|---|---|---|
| 2-14 | 0.0045 | 4.05 | 3.2 | 0.94 | Invention example |
| 2-15 | 0.0031 | 4.88 | 3.5 | 0.98 | Invention example |
| 2-16 | 0.0054 | 9.74 | 6.5 | 0.9 | Invention example |
| 2-17A | 0.0065 | 3.41 | 2.9 | 0.91 | Invention example |
| 2-17B | 0.0065 | 3.41 | 3.1 | 0.92 | Invention example |
| 2-17C | 0.0065 | 3.41 | 4.3 | 0.77 | Comparative example |
| 2-18A | 0.0068 | 6.24 | 2.5 | 0.96 | Invention example |
| 2-18B | 0.0068 | 6.24 | 3.8 | 0.92 | Invention example |
| 2-19A | 0.0061 | 2.75 | 2.6 | 0.91 | Invention example |
| 2-19B | 0.0061 | 2.75 | 2.5 | 0.9 | Invention example |
| 2-20 | 0.0068 | 5.87 | 4.7 | 0.92 | Invention example |
| 2-21A | 0.0054 | 5.67 | 3.3 | 0.94 | Invention example |
| 2-21B | 0.0054 | 5.67 | 4.6 | 0.92 | Invention example |
| 2-21C | 0.0054 | 5.67 | 6.2 | 0.71 | Comparative example |
| 2-22A | 0.0117 | 3.63 | 3.4 | 0.65 | Comparative example |
| 2-22B | 0.0117 | 3.63 | 3.6 | 0.62 | Comparative example |
| 2-23 | 0.0146 | 5.97 | 5.2 | 0.6 | Comparative example |
| 2-24 | 0.0116 | 4.08 | 3.9 | 0.64 | Comparative example |
| 2-25 | 0.0077 | 5.46 | 5.1 | 0.9 | Invention example |
| 2-26 | 0.0086 | 4.04 | 3.9 | 0.73 | Comparative example |
| 2-27 | 0.0079 | 11.51 | 12.4 | 0.72 | Comparative example |
| 2-28 | 0.0081 | 8.63 | 9.4 | 0.75 | Comparative example |

As shown in Tables 2 to 17, the anisotropies in ultimate deformability (ultimate deformation ratios) showed favorable values of 0.9 or more in the steel plates that fulfilled the component ranges and production conditions of the embodiments. Results were obtained in which anisotropy in deformability (workability) was small, and the anisotropy in deformability (workability) is an index of workability effective for preventing occurrence of cracking in a specific direction during plate press forging. In contrast, with regard to the steel plates of which the components were outside the ranges of the embodiments, and the steel plates which were manufactured under conditions that did not fulfill the conditions of the embodiments and which had the components within the ranges of the embodiments, the ultimate deformability ratios were less than 0.9; and therefore, the anisotropies in deformability (workability) were large.

Example 4

Preparation of the Surface Treatment Fluid

Firstly, surface treatment fluids (chemicals) a to s were prepared which contained the components as shown in the following Tables 18 and 19. Meanwhile, in Tables 18 and 19, in the case where zinc nitrate and phosphate were included as an inorganic compound and an acid respectively, zinc phosphate was present in the surface treatment fluid as the inorganic acid salt. It is extremely difficult to dissolve zinc phosphate in water; however, zinc phosphate dissolves in acid. Therefore, water-soluble zinc nitrate and phosphate were added so as to generate zinc phosphate and make the zinc phosphate present in the surface treatment fluid.

TABLE 18

| Chemical | Silane coupling agent: Type | Silane coupling agent: Added amount (g/L) | Inorganic compound: Type | Inorganic compound: Added amount (g/L) | Acid: Type | Acid: Added amount (g/L) | Organic compound: Type | Organic compound: Added amount (g/L) | Lubricant: Type | Lubricant: Added amount (g/L) | pH |
|---|---|---|---|---|---|---|---|---|---|---|---|
| a | 3-aminopropyltrimethoxy silane | 12 | Zinc nitrate | 120 | Phosphate | 3 | Polyamine imide resin | 120 | $MoS_2$ | 600 | 4 |
| b | N-2-(aminoethyl)-3-aminopropylmethyldimethoxy silane | 12 | Zinc nitrate | 30 | Phosphate | 3 | Polyamine imide resin | 150 | $MoS_2$ | 200 | 4 |
| c | N-2-(aminoethyl)-3-aminopropylmethyldimethoxy silane | 12 | Zinc nitrate | 60 | Phosphate | 3 | Polyamine imide resin | 150 | $MoS_2$ | 500 | 4 |
| d | N-2-(aminoethyl)-3-aminopropylmethyldimethoxy silane | 12 | Zinc nitrate | 60 | Phosphate | 3 | Polyamine imide resin | 150 | $MoS_2$ | 2000 | 4 |
| e | N-2-(aminoethyl)-3-aminopropylmethyldimethoxy silane | 12 | Zinc nitrate | 60 | Phosphate | 3 | Polyamine imide resin | 150 | $MoS_2$ | 350 | 4 |
| f | N-2-(aminoethyl)-4-aminopropylmethyldimethoxy silane | 12 | Potassium molybdate | 60 | Phosphate | 3 | Polyamine imide resin | 150 | PTFE | 200 | 4 |
| g | N-2-(aminoethyl)-5-aminopropylmethyldimethoxy silane | 12 | Potassium molybdate | 60 | Phosphate | 3 | Polyamine imide resin | 150 | ZnO | 600 | 4 |
| h | 3-aminopropyltrimethoxy silane | 12 | Zinc nitrate | 60 | Phosphate | 3 | Polyester resin | 150 | $MoS_2$ | 1100 | 4 |

TABLE 18-continued

| | Silane coupling agent | | Inorganic compound | | Acid | | Organic compound | | Lubricant | | |
|---|---|---|---|---|---|---|---|---|---|---|---|
| Chemical | Type | Added amount (g/L) | Type | Added amount (g/L) | Type | Added amount (g/L) | Type | Added amount (g/L) | Type | Added amount (g/L) | pH |
| i | 3-aminopropyltrimethoxy silane | 12 | Zinc nitrate | 60 | Phosphate | 3 | Epoxy resin | 150 | $MoS_2$ | 5050 | 4 |

TABLE 19

| | Silane coupling agent | | Inorganic compound | | Acid | | Organic compound | | Lubricant | | |
|---|---|---|---|---|---|---|---|---|---|---|---|
| Chemical | Type | Added amount (g/L) | Type | Added amount (g/L) | Type | Added amount (g/L) | Type | Added amount (g/L) | Type | Added amount (g/L) | pH |
| j | 3-aminopropyltrimethoxy silane | 12 | Zinc nitrate | 40 | Phosphate | 3 | Epoxy resin | 4.3 | Graphite | 25 | 4 |
| k | 3-aminopropyltrimethoxy silane | 12 | Potassium silicate | 1 | — | — | Polyamine imide resin | 100 | $MoS_2$ | 500 | 4 |
| l | 3-aminopropyltrimethoxy silane | 12 | Potassium molybdate | 40 | — | — | Fluororesin | 40 | $MoS_2$ | 4000 | 4 |
| m | 3-aminopropyltrimethoxy silane | 12 | Potassium tungstate | 40 | — | — | Fluororesin | 100 | $MoS_2$ | 170 | 4 |
| n | 3-aminopropyltrimethoxy silane | 1 | Zinc nitrate | 120 | Phosphate | 3 | Polyamine imide resin | 120 | Graphite | 240 | 4 |
| o | 3-aminopropyltrimethoxy silane | 100 | Zinc nitrate | 12 | Phosphate | 3 | Polyamine imide resin | 12 | Graphite | 120 | 4 |
| p | 3-aminopropyltrimethoxy silane | 12 | Zinc nitrate | 1 | Phosphate | 0.5 | Polyamine imide resin | 188 | $MoS_2$ | 350 | 4 |
| q | 3-aminopropyltrimethoxy silane | 12 | Zinc nitrate | 150 | Phosphate | 20 | Polyamine imide resin | 17 | $MoS_2$ | 500 | 4 |
| r | 3-aminopropyltrimethoxy silane | 12 | Zinc nitrate | 60 | Phosphate | 3 | Polyamine imide resin | 150 | $MoS_2$ | 100 | 4 |
| s | 3-aminopropyltrimethoxy silane | 12 | Zinc nitrate | 5 | Phosphate | 1 | Polyamine imide resin | 5 | $MoS_2$ | 1500 | 4 |

(Production of the Steel Plate for Cold Forging)

Next, a surface-treated film having a concentration-gradient type three-layer structure was formed on both surfaces of a hot-rolled steel plate (material, a main body portion of a steel plate) by the following method using any one of the surface treatment fluids a to s that were prepared in the above-described manner; and thereby, steel plates for cold forging (Nos. 3-1 to 3-29) were manufactured (refer to the following Table 21).

Firstly, a steel having the components as shown in Table 20 were melted through an ordinary converter-vacuum degassing treatment so as to make a slab. Next, hot rolling, cooling, and coiling were carried out under the conditions of the first embodiment so as to obtain hot-rolled steel plates (a plate thickness was 0.8 mm).

Any one of the surface treatment fluids a to s was coated on the hot-rolled steel plate using a coating No. #3 bar so as to form a coated film, and then the coated film was dried. Here, the coating No. #3 bar refers to a bar coater having a coiled wire diameter of 3 mils (1 mil=25 μm). The drying was carried out under conditions in which an achieving temperature of the plate was 150° C. in a hot air drying furnace having a temperature of 300° C. After the drying, air-cooling was conducted so as to obtain steel plates for cold forging.

Thicknesses of the respective layers (film thicknesses) were controlled by adjusting (diluting) concentrations of the surface treatment fluids or adjusting times from the forming of the coated films to the drying.

TABLE 20

| C | Si | Mn | P | S | Al | N | O |
|---|---|---|---|---|---|---|---|
| 0.15 | 0.36 | 1.04 | 0.012 | 0.0052 | 0.016 | 0.0032 | 0.0012 |

(Measurement of Film Thicknesses (Layer Thicknesses))

In the present example, the film thicknesses (layer thicknesses) were measured using a high-frequency GDS. In detail, a depth (a location in the film thickness direction) of a portion having a peak intensity of half the maximum value of a peak intensity of a representative element (for example, Mo, C, or the like) of the lubricant from an outermost surface of the surface-treated film in a measurement chart of the high-frequency GDS was used as a thickness of a lubricant layer. In addition, a depth (a location in the film thickness direction) of a portion having a peak intensity of half the maximum value of a peak intensity of a representative element (Si) of the component originating from the silanol bond from an interface between the surface-treated film and the hot-rolled steel plate in the measurement chart of the high-frequency GDS was used as a thickness of an adhesion layer. Furthermore, a depth from the portion having a peak intensity of half the maximum value of the peak intensity of the representative element (Mo) of the lubricant to the portion having the peak intensity of half the maximum value of the peak intensity of the representative element (Si) of the component originating from the silanol bond was used as a thickness of a base layer. In addition, in the case where the representative elements of the lubricant layer (lubricant component) and the base layer (inorganic acid salt component) were the same, and in the case where the component elements of the base layer (inorganic acid salt component) and the adhesion layer (component originating from the silanol bond) were the same, contents of other elements were measured so as to obtain the thicknesses.

However, in the case where graphite was used as the lubricant, the thicknesses of the lubricant layer and the base layer were measured using the peak intensities of the representative elements (P, Si, Mo, and W) of the inorganic acid salt.

(Evaluation Method and Evaluation Standards)

In the present example, film adhesion and workability of the steel plate for cold forging were evaluated using the evaluation method and the evaluation standards as shown below.

<Evaluation of the Film Adhesion>

The film adhesion was evaluated in a drawing sliding test in which a flat bead mold was used. An article having a size of 30 mm×200 mm from which shear burrs at edges were removed was used as a test specimen. With regard to the test specimen before being slid, fluorescent X-ray intensities of main component elements of the film were measured using a fluorescent X-ray analyzer.

Surfaces of molds made of SKD 11 which had a length of 40 mm, a width of 60 mm, and a thickness of 30 mm were polished using Emery paper No. #1000 so as to prepare a pair of molds as flat bead molds. Next, the test specimen was sandwiched between the molds, and the test specimen was drawn using a tension tester in a state where the molds were pressed down at a pressure of 1000 kg by an air cylinder. With regard to the test specimen that had undergone the drawing, fluorescent X-ray intensities of the same elements as described above were measured using the fluorescent X-ray analyzer. Then, a residual rate (intensity after the test/intensity before the test)×100 [%] was calculated.

Regarding evaluation standards of a film adhesion, a steel plate of which the residual rate was less than 70% was evaluated as C (Bad), a steel plate which the residual rate was in a range of 70% or more to less than 90% was evaluated as B (Good), and a steel plate of which the residual rate was 90% or more was evaluated as A (Excellent).

<Evaluation of the Workability>

Figure 7A:
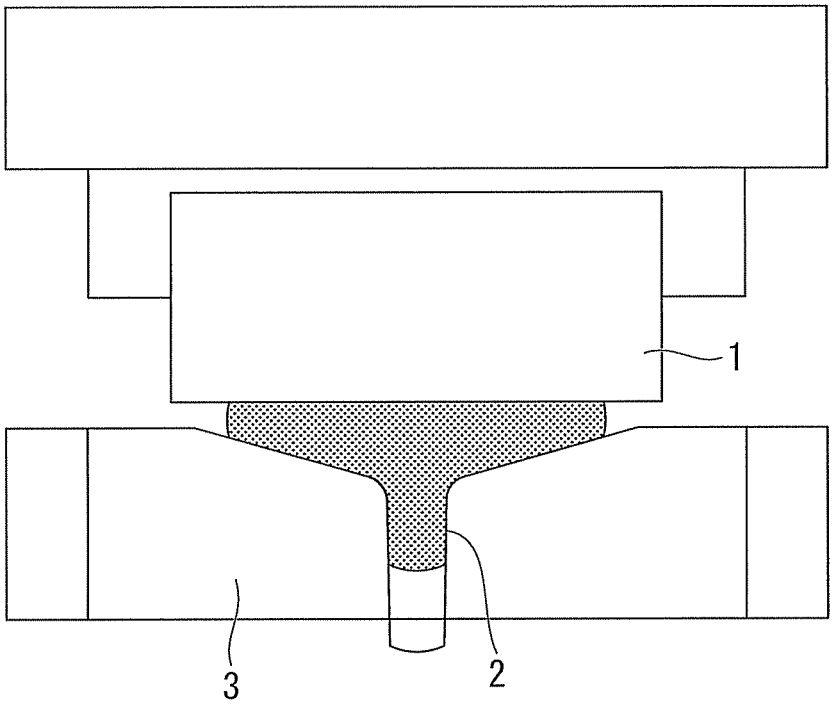
FIG. 7A is an explanatory view for explaining a spike test method.
Figure 7B:
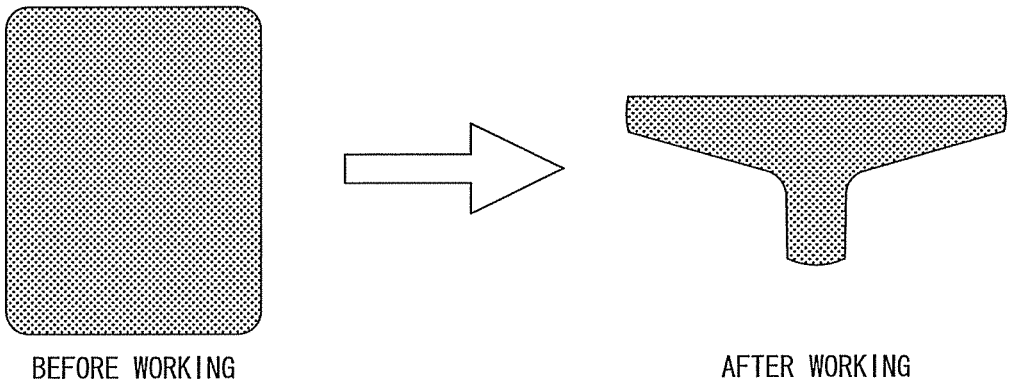
FIG. 7B is a view showing shapes of a test specimen before and after working by the spike test method.

Workability was evaluated by a spike test method. In the spike test, a columnar spike test specimen 2 was placed on a die 3 having a funnel-shaped inner surface shape as shown in FIG. 7A. Next, a load was applied through a plate 1 so as to insert the spike test specimen 2 into the die 3. Thereby, the spike test specimen 2 was worked into a shape after the working as shown in FIG. 7B. A spike was formed according to the die shape in the above-described manner, and lubricity was evaluated based on a spike height (mm) at this time. Therefore, a test specimen having a tall spike height is evaluated to be excellent in the lubricity.

The workability was evaluated based on the spike height. The spike height of a sample produced by a chemical reaction/metal saponification treatment in the related art is in a range of 12.5 mm to 13.5 mm. Therefore, a steel plate of which the spike height was less than 12.5 mm was evaluated as C (Bad), a steel plate of which the spike height was in a range of 12.5 mm to 13.5 mm was evaluated as B (Good), and a steel plate of which the spike height was more than 13.5 mm was evaluated as A (Excellent).

The measurement results of the film thicknesses of the respective layers and the evaluation results of the film adhesion and the workability which were obtained in the above-described manner are shown in Table 21.

Meanwhile, the amount of the inorganic acid salt relative to the amount of the high-temperature resin in the base layer became the same as the amount of the inorganic acid salt relative to the amount of the high-temperature resin in the surface treatment fluid.

TABLE 21

| Test specimen No. | Chemical | Adhesion layer (nm) | Base layer (μm) | Mixing ratio of inorganic acid salt to high-temperature resin (%) | Lubricant layer (μm) | Thickness of lubricant layer/ thickness of base layer | Film adhesion | Work-ability | Note |
|---|---|---|---|---|---|---|---|---|---|
| 3-1 | a | 10 | 4 | 100 | 1 | 0.25 | A | A | Invention example |
| 3-2 | b | 15 | 4 | 20 | 0.8 | 0.2 | A | A | Invention example |
| 3-3 | c | 10 | 4 | 40 | 1 | 0.25 | A | A | Invention example |
| 3-4 | d | 12 | 0.2 | 40 | 0.1 | 0.5 | A | B | Invention example |
| 3-5 | e | 13 | 15 | 40 | 7.5 | 0.5 | A | B | Invention example |
| 3-6 | c | 13 | 0.5 | 40 | 1 | 2 | A | A | Invention example |
| 3-7 | c | 13 | 3 | 40 | 1 | 0.33 | A | A | Invention example |
| 3-8 | c | 0.1 | 4 | 40 | 1 | 0.25 | B | A | Invention example |
| 3-9 | c | 0.5 | 4 | 40 | 1 | 0.25 | A | A | Invention example |
| 3-10 | c | 50 | 4 | 40 | 1 | 0.25 | A | A | Invention example |
| 3-11 | c | 100 | 4 | 40 | 1 | 0.25 | B | A | Invention example |
| 3-12 | f | 11 | 4 | 40 | 1 | 0.25 | A | A | Invention example |
| 3-13 | g | 12 | 4 | 40 | 1 | 0.25 | A | A | Invention example |
| 3-14 | h | 11 | 4 | 40 | 10 | 2.5 | A | B | Invention example |
| 3-15 | i | 10 | 4 | 40 | 2 | 0.5 | A | B | Invention example |

TABLE 21-continued

| Test specimen No. | Chemical | Adhesion layer (nm) | Base layer (μm) | Mixing ratio of inorganic acid salt to high-temperature resin (%) | Lubricant layer (μm) | Thickness of lubricant layer/ thickness of base layer | Film adhesion | Work-ability | Note |
|---|---|---|---|---|---|---|---|---|---|
| 3-16 | j | 11 | 4 | 1000 | 1 | 0.25 | A | B | Invention example |
| 3-17 | k | 11 | 4 | 1 | 2 | 0.5 | A | A | Invention example |
| 3-18 | l | 12 | 0.1 | 100 | 1 | 10 | A | A | Invention example |
| 3-19 | m | 11 | 4 | 40 | 1 | 0.25 | A | A | Invention example |
| 3-20 | c | 13 | 0.1 | 40 | 0.05 | 0.5 | A | C | Comparative example |
| 3-21 | c | 12 | 4 | 40 | 12 | 3 | A | C | Comparative example |
| 3-22 | c | 12 | 0.05 | 40 | 0.1 | 2 | A | C | Comparative example |
| 3-23 | c | 11 | 16 | 40 | 4 | 0.25 | A | C | Comparative example |
| 3-24 | n | 0.05 | 4 | 100 | 1 | 0.25 | C | C | Comparative example |
| 3-25 | o | 150 | 2 | 100 | 1 | 0.5 | C | C | Comparative example |
| 3-26 | p | 14 | 2 | 0.8 | 1 | 0.5 | A | C | Comparative example |
| 3-27 | q | 13 | 2 | 1200 | 1 | 0.5 | A | C | Comparative example |
| 3-28 | r | 13 | 10 | 40 | 1 | 0.1 | A | C | Comparative example |
| 3-29 | s | 12 | 1 | 120 | 15 | 15 | A | C | Comparative example |

As shown in Table 21, all the invention examples (Nos. 3-1 to 3-19) of the second embodiment were excellent in the film adhesion and the workability. On the other hand, the comparative examples (Nos. 3-24 and 3-25) in which the thicknesses of the adhesion layers were outside the range of the second embodiment were poor in the film adhesion and the workability. Furthermore, the comparative examples (Nos. 3-20 to 3-29) that did not fulfill any of the requirements as defined in the second embodiment were poor in the workability (lubricity).

INDUSTRIAL APPLICABILITY

According to the embodiments of the invention, it is possible to provide a steel plate for cold forging (hot-rolled steel plate) having anisotropy in ultimate deformability (ultimate deformation ratio) during cold press forging working of 0.9 or more which indicates that anisotropy in workability is small; and therefore, cracking during press forging working can be prevented. Furthermore, excellent lubricity and excellent performance to prevent seizure and galling can be achieved by further including the surface-treated film according to the embodiment of the invention. Therefore, the workability in cold molding, so-called plate press forging can be improved. Therefore, in the case where the steel plate for cold forging according to the embodiment of the invention is used as a material, parts for engines or transmissions which were produced by hot forging or the like in the related art can be produced by plate press forging. As described above, the steel plate for cold forging according to the embodiment of the invention can be widely used as a material for plate press forging.

The invention claimed is:

1. A steel plate for cold forging comprising:

a hot-rolled steel plate, wherein the hot-rolled steel plate comprises: in terms of percent by mass, C: 0.13% to 0.20%;

Si: 0.01% to 0.8%;

Mn: 0.6% to 2.5%;

P: 0.003% to 0.030%;

S: 0.0001% to 0.008%;

Al: 0.01% to 0.07%;

N: 0.0001% to 0.02%; and

O: 0.0001% to 0.0030%, with a remainder being Fe and inevitable impurities, an A value represented by following formula (1) is in a range of 0.0080 or less, a thickness of the hot-rolled steel plate is in a range of 2 mm to 25 mm, and an area percentage of pearlite bands having lengths of 1 mm or more is in a range of not more than a K value represented by following formula (2) in a region of $\frac{4}{10}$t to $\frac{6}{10}$t when a plate thickness is indicated by t in a cross section of a plate thickness that is parallel to a rolling direction of the hot-rolled steel plate, $$A \text{ value} = O\% + S\% + 0.033Al\% \quad (1)$$

$$K \text{ value} = 25.5 \times C\% + 4.5 \times Mn\% - 6 \quad (2).$$

2. The steel plate for cold forging according claim 1, wherein the hot-rolled steel plate further comprises, in terms of percent by mass, one or more selected from a group consisting of:

Nb: 0.001% to 0.1%;

Ti: 0.001% to 0.05%;

V: 0.001% to 0.05%;

Ta: 0.01% to 0.5%; and

W: 0.01% to 0.5%.

* * * * *